US008146260B1

(12) United States Patent
Visser

(10) Patent No.: US 8,146,260 B1
(45) Date of Patent: Apr. 3, 2012

(54) FRAMING SQUARE

(76) Inventor: Fredric J. Visser, Huntington, NY (US)

( * ) Notice: Subject to any disclaimer, the term of this patent is extended or adjusted under 35 U.S.C. 154(b) by 0 days.

(21) Appl. No.: 13/227,465

(22) Filed: Sep. 7, 2011

(51) Int. Cl.
*B43L 7/12* (2006.01)

(52) U.S. Cl. ..... 33/415; 33/418

(58) Field of Classification Search ..... 33/415–426
See application file for complete search history.

(56) References Cited

U.S. PATENT DOCUMENTS

| | | | | |
|---|---|---|---|---|
| 1,648,266 | A * | 11/1927 | Grass | 33/478 |
| 3,416,232 | A * | 12/1968 | Overbay | 33/424 |
| 4,212,108 | A | 7/1980 | Jackson | |
| 4,361,964 | A | 12/1982 | Hennessee | |
| 4,574,492 | A | 3/1986 | Miller | |
| 5,456,015 | A | 10/1995 | Butcher et al. | |
| 5,727,325 | A | 3/1998 | Mussell | |
| 5,813,126 | A | 9/1998 | Dahl | |
| 5,819,427 | A | 10/1998 | Rohweder | |
| D455,085 | S | 4/2002 | Dawson | |
| 6,604,296 | B2 | 8/2003 | Mastrobattista | |
| 6,662,460 | B2 | 12/2003 | Evans | |
| 6,820,345 | B2 | 11/2004 | Evans | |
| 6,868,616 | B2 | 3/2005 | Allemand | |
| 7,398,601 | B2 | 7/2008 | Morrell | |
| 7,481,143 | B2 * | 1/2009 | Hiland, Jr. | 33/418 |
| 7,546,687 | B2 | 6/2009 | Haala | |
| 7,587,838 | B2 | 9/2009 | Mastrobattista | |
| 8,074,368 | B2 * | 12/2011 | Atwood | 33/418 |
| 2010/0139106 | A1 * | 6/2010 | Atwood | 33/418 |
| 2011/0107610 | A1 * | 5/2011 | Farr et al. | 33/421 |

* cited by examiner

*Primary Examiner* — G. Bradley Bennett
(74) *Attorney, Agent, or Firm* — Harvey Lunenfeld

(57) ABSTRACT

A folding framing square, comprising a substantially right triangular shaped framing square having a flange attached substantially perpendicular thereto and forming a substantially "T" shaped section therewith, a substantially right-angled trapezium shaped framing square hingedly attached to the flange; and optionally having a ring hingedly attached to the flange, the ring adapted to allow a user to removably insert a finger therethrough and facilitate the user to hold the folding framing square. The substantially right-angled trapezium shaped framing square and the ring may each be independently folded from an open to a closed position and vice versa. An alternate embodiment comprises a substantially right triangular shaped framing square having a flange attached substantially perpendicular thereto, a substantially right-angled trapezium shaped framing square hingedly attached to a clamp, the clamp adapted to be removably and releasably attached to the flange.

23 Claims, 23 Drawing Sheets

FRAMING SQUARE

BACKGROUND OF THE INVENTION

1. Field of the Invention

The present invention relates generally to framing squares and more particularly to folding and enhanced grip framing squares.

2. Background Art

Framing squares for framing buildings, homes, and other construction have been known. Typical uses include measuring and marking right angles and other angles, which form the bases of modern day building, home, and other construction, including, for example, laying out construction members, such as studs, rafters, plates, stairs, and risers, measuring and pitching roofs.

Framing squares are so valuable in building, home, and other construction that the squares can be used in a large variety of applications, from stair framing to roof framing, location of studs on plates, measuring and constructing hip/valley rafters, jack rafters, plumb cuts of jack and common rafters, plumb cuts of hip/valley rafters, Modern framing squares, sometimes called speed squares, are often right triangular in shape, whereas previously heretofore known framing squares were "L" shaped, had only two sides, typically of different length and width, and were often called steel squares. The newer triangular shaped framing square may also be called a speed square, carpenter's square, or rafter square, and may also have a variety of optional markings, which may be used to enhance ease and functionality of use for particular applications, such as, for example, measuring the pitch of a roof or other specialized applications.

Triangular shaped framing squares are typically of substantially planar construction, and may have a variety of optional cutouts and optional raised edges. The optional markings may be placed on the framing square adjacent the cutouts to facilitate a wide variety of markings and measurements, and the raised edges may be used, for example, for abutting against an edge of a plate and aligning the framing square with the edge of the plate to facilitate marking the top of the plate and/or during measurements.

Although the triangular shaped framing square, does facilitate many measurements, it is time consuming, however, to use the triangular shaped framing square to mark and measure both the top and front of a plate quickly, which most often requires a two step process, such as, for example, measuring and marking the top of the plate where the stud should be located, and then vertically aligning the triangular shaped framing square with the markings on the top of the plate, while abutting the framing square against the front edge of the plate, and marking the front edge of the plate.

There is thus a need for a framing tool, such as, for example, a triangular or similar shaped framing square, that facilitates quick and almost simultaneous measurement and/or marking of two transverse surfaces, which are most often perpendicular to one another. The framing tool should be easy to carry, store, and fold into a compact shape, when not in use, and quick and easy to fully open or partially open, as required, for marking and measurement, and should have means for gripping and/or holding the tool in a manner that minimizes the potential for dropping or losing the framing tool.

The framing tool should preferably be a triangular shaped framing square, which may optionally have indicia and/or other means to facilitate other types of measurements and markings, although other suitable shapes may be used. The framing tool should be quick and easy to use, handle, store, open fully or partially, as required, and facilitate rapid measurement and marking of transverse surfaces on building materials. The framing tool should also have means for securely holding the tool, when being used in a variety of difficult environmental conditions, such as rain, snow, wind and other difficult work environments, and be capable of being stored as an appendage to a user's belt or work belt, or in a suitable holster attached the belt or work belt.

The framing tool should be durable, light weight, inexpensive, safe to use, attractive, sturdy, of simple construction, and capable of being used in a quick, convenient, and efficient manner.

Different framing squares have heretofore been known. However, none of the framing squares adequately satisfies these aforementioned needs.

Triangular shaped builders' measuring and marking tools, multipurpose squares, and carpenter's pitch squares have been disclosed.

- U.S. Pat. No. 6,868,616 (Allemand) discloses a builder's measuring and marking tool, which comprises a planar member having a right triangle configuration, including a first side edge, a second side edge extending normal to the first side edge, and a third side edge intersecting the first and second side edges to form a hypotenuse of the right triangle configuration. The tool also comprises an elongated aperture spaced apart inwardly from the third side edge and bounded by at least one straight edge parallel to the third side edge, and first hip and valley marking indicia formed along the at least one straight edge of the elongated aperture. In addition, the tool comprises an aperture having a first inner side edge parallel to the at least one straight edge of the elongated aperture and second hip and valley marking indicia formed along the first inner side edge.
- U.S. Pat. No. 5,727,325 (Mussell) discloses a multipurpose square. The square includes indicia in calibrated scales for rafter, angle, and linear measurements. The square has a profile which facilitates the rapid marking of layouts for various standard dimensional construction materials as well as marking cuts for stair stringers and bond timbers. The square is configured to allow it to be "holstered" or carried in the pockets of standard tool aprons so as to be accessible to a tradesman.
- U.S. Pat. No. 7,398,601 (Morrell) discloses a carpenter's pitch square having includes a triangular base having first and second sides joined to form a right angle. A first elongated slot is disposed within the base parallel to a third side thereof, and a pin is selectively positionable along the length of the slot. The pin provides a mechanism for fixing the base in a specific orientation relative to an edge of an object, when the pin is in a locked position within the slot.

Folding carpenter's squares, bevels, and sliding bevels having articulating joints that form triangular shaped squares have been disclosed.

- U.S. Pat. No. 6,662,460 (Evans) discloses a folding carpenter's square, bevel, and sliding bevel. The combination carpenter square and bevel/sliding bevel has three triangle-shaped adjoining legs, with an articulating joint between the hypotenuse leg and each adjoining leg. The other two non-hypotenuse legs are capable of being latched or detached by a latching joint that, when latched, forms a substantially 90 degree angle between the two non-hypotenuse legs to function as a carpenter's square. One of the articulating joints at the hypotenuse leg is capable of tightening and loosening. The hypotenuse leg also consists of a slot positioned longitudinally of the hypotenuse leg. The tightening and loosening articulated joint joins the hypotenuse leg with an adjacent leg through the slot, which allows the adjacent leg movement about the joint relative to the hypotenuse leg to function as a bevel. The articulated joints and the detaching function of the latching joint allow the combination square and bevel/sliding bevel to be folded into a compact shape. U.S. Pat. No. 6,820,345 (Evans), which is a continuation-in-part of U.S. Pat. No. 6,662,460 (Evans) also discloses a folding carpenter's square, bevel, and sliding bevel.

Folding lay out squares and folding framing tools have been disclosed.

U.S. Pat. No. 4,361,964 (Hennessee) discloses a lay out square that can be folded from a flat position for storage to a position wherein the legs are substantially perpendicular to each other. The lay out square, which is used for constructing wall sections, comprises: first and second legs and a first end member joining the first and second legs to form a first U-shaped member, the first and second legs having a width and spacing therebetween equal to that of the edge width of construction members being used; third and fourth legs and a second end member joining the third and fourth legs to form a second U-shaped member, the third and fourth legs spaced apart to align with the first and second legs; and a self-locking hinge adapted to lock, when the first U-shaped member is substantially perpendicular to the second U-shaped member.

U.S. Pat. No. 7,546,687 (Haala) discloses a framing tool that uses two hinged L-shaped squares to locate an object perpendicular to a plane. The framing tool is placed against the plane with the L-shaped squares offset angularly with respect to each other. The object to be secured to the plane is placed adjacent to a hinge and within fins parallel to the hinge, which then allows the object to be secured perpendicularly to the plane with one hand, while holding the framing tool and the object with the other hand.

U.S. Pat. No. 4,212,108 (Jackson) discloses a layout tool for framing studs, which includes a straight elongated bar having a flat top surface to which are pivoted first and second narrow bar segments. The bar segments are arranged to swing about their pivots between closed positions in which the segments overlie the bar to open positions in which the segments run transverse to the bars at right angles. The distance between the segments is made equal to the desired distance between the framing studs, so that the tool can be positioned alongside a baseboard to which the framing studs are to be attached and appropriate pencil marks made using the segments as ruler edges. The tool is designed to accommodate four bar segments uniformly spaced in accord with the desired stud spacing, so that four stud position markings can be effected with a single application of the tool. Also, the tool is designed for disassembly to permit compact storage.

Speed squares with extension bars and framing rafter attachments have been disclosed.

U.S. Pat. No. 5,813,126 (Dahl) discloses a speed square extension bar and saw guide, in which a channel extending longitudinally through an extension bar snugly but slidably receives the base flange of a speed square. The extension bar can be locked in a desired position relative to the square, and has a mechanism for mounting a stop peg at a desired position along the length of the bar. The position of the square relative to a board to be marked or cut is set by engaging the stop peg against the end of the board while the extension bar is held flush against a longitudinal edge of the board. Each of several different boards can be marked at a predetermined desired length and/or an edge of the speed square can be used as a guide fence for a portable power saw.

U.S. Pat. No. 7,587,838 (Mastrobattista) discloses a framing rafter square attachment. The attachment cooperates with a conventional rafter or framing square to facilitate repetitive cutting of lengths of framing lumber (such as for blocking). The attachment allows the position of the framing square as held by the attachment to be adjustable, so that it can accommodate a variety of circular saw fence configurations. The attachment is extendable and retractable. A drag clip may be provided to allow a user to selectively pinch a piece of wood with the attachment, so that the pinched piece of wood can then be repositioned for another cut, without the user having to set down either the circular saw or the attachment. The attachment also has a subassembly that allows the user to cut a piece of lumber to fit a preexisting length or opening.

U.S. Pat. No. 6,604,296 (Mastrobattista) discloses an attachment for a framing square, the framing square being defined by a triangular base and a flange, the base further defined by a fence edge. The attachment has a frame member defined by a first retaining channel for accepting the framing square flange therein, the first retaining channel defining an axis. The framing square is held in position by a clamp having a threaded knob that screws into a back side of the first retaining channel. The frame member has a U-shaped segment member defined by a first end and a second end. The attachment has an extension member extendable from the frame member substantially parallel to the axis. The first retaining channel extends from the first end, and a second retaining channel extends from the second end, the second retaining channel being configured to accept the extension member therein.

Carpenter's pull-apart framing squares have been disclosed.

U.S. Pat. No. 5,819,427 (Rohweder) discloses a carpenter's pull-apart framing square. The carpenter's square has arms thereof separated to facilitate storage, and joined together during use, and includes a over-center latch arrangement designed to be no thicker than the thickness dimension of the arm members and which, when operated, tightly clamps the arms of the square at right angles to one another. A first arm of the square has an opening formed through the thickness dimension thereof along with alignment bores extending inwardly from a side edge thereof on either side of the opening. The second arm includes the over-center latch pivotally mounted in a slot or channel and includes a latch plate pivotally joined to a coupling member having a head thereon designed to fit within the opening on the first arm member. When the latch plate is manually actuated so as to reside within the slot of the second arm, the head on the coupling member cooperates with an edge defined by the opening in the first arm to clamp the first and second arms one to the other.

Other construction framing squares and combination layout tools and squares have been disclosed.

U.S. Pat. No. 5,456,015 (Butcher, et al.) discloses a construction framing square that is designed for use in conjunction with a conventional tape measure. The tape measure is attached to the construction framing square, which forms a right angle with respect to the layout square, and may be used for measuring distances for a framing layout, enabling a user to mark multiple parallel lines in a perpendicular direction at specified distances measured from an end of the tape. The square has indicia in calibrated scales for rafter, angle and linear measurements, an elongated base, and a guide attached to and perpendicular to the base. The base and the guide have edges and notches for dimensional marking and indicia placement.

U.S. Pat. No. D455,085 (Dawson) discloses an ornamental design for a framing template.

U.S. Pat. No. 4,574,492 (Miller) discloses a combination layout tool and square that includes a layout tool, which has a rectangular plate and rectangular end piece, and a square adapter, which has an attachment plate and a ruler assembly. The layout tool is provided with slots and apertures, which allow a construction worker to make standard measurements. The square adapter includes a pivotal ruler, which can be aligned parallel to or perpendicular to longitudinal edges of the layout tool.

For the foregoing reasons, there is a need for a framing tool that facilitates quick and almost simultaneous measurement and/or marking of two transverse surfaces, which are most often perpendicular to one another. The framing tool should be easy to carry, store, and fold into a compact shape, when not in use, and quick and easy to fully open or partially open, as required, for marking and measurement, and should have means for gripping and/or holding the tool in a manner that minimizes the potential for dropping or losing the framing tool, especially when being used in a variety of difficult environmental conditions, such as rain, snow, wind and other difficult work environments.

The framing tool should be capable of being stored as an appendage to a user's belt or work belt, or in a suitable holster attached the belt or work belt, and should be durable, light weight, inexpensive, safe to use, attractive, sturdy, of simple construction, and capable of being used in a quick, convenient, and efficient manner.

SUMMARY

The present invention is directed to a framing tool that facilitates quick and almost simultaneous measurement and/or marking of two transverse surfaces. The framing tool is easy to carry, store, and fold into a compact shape, when not in use, and quick and easy to fully open or partially open, as required, for marking and measurement, and has means for gripping and/or holding the tool in a manner that minimizes the potential for dropping or losing the framing tool, especially when being used in a variety of difficult environmental conditions, such as rain, snow, wind and other difficult work environments.

A folding framing square having features of the present invention comprises: a substantially right triangular shaped framing square having a flange attached substantially perpendicular thereto and forming a substantially "T" shaped section therewith, and having a substantially right-angled trapezium shaped framing square hingedly attached to the flange.

The folding framing square may optionally having a ring hingedly attached to the flange and opposing the right-angled trapezium shaped framing square, the ring adapted to allow a user to removably insert a finger therethrough and facilitate the user to hold the folding framing square. The substantially right-angled trapezium shaped framing square hingedly attached to the flange and the ring hingedly attached to the flange may each be independently folded from an open to a closed position and vice versa.

An alternate embodiment of a folding framing square comprises a substantially right triangular shaped framing square having a flange attached substantially perpendicular thereto, a substantially right-angled trapezium shaped framing square hingedly attached to a clamp, the clamp adapted to be removably and releasably attached to the flange.

DRAWINGS

These and other features, aspects, and advantages of the present invention will become better understood with regard to the following description, appended claims, and accompanying drawings where:

DESCRIPTION

The preferred embodiments of the present invention will be described with reference to FIGS. 1-24 of the drawings. Identical elements in the various figures are identified with the same reference numbers.

Figure 1:
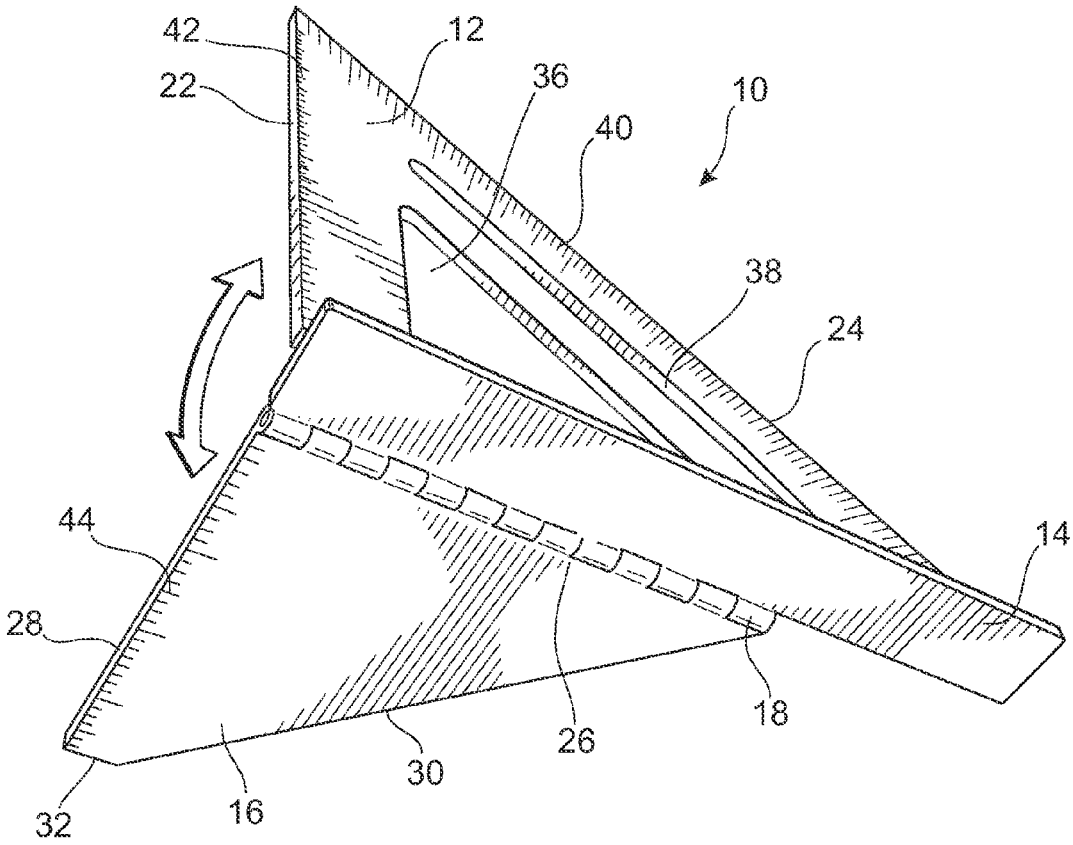
FIG. 1 is a perspective view of a framing square, constructed in accordance with the present invention, showing the framing square in an open position.
Figure 2:
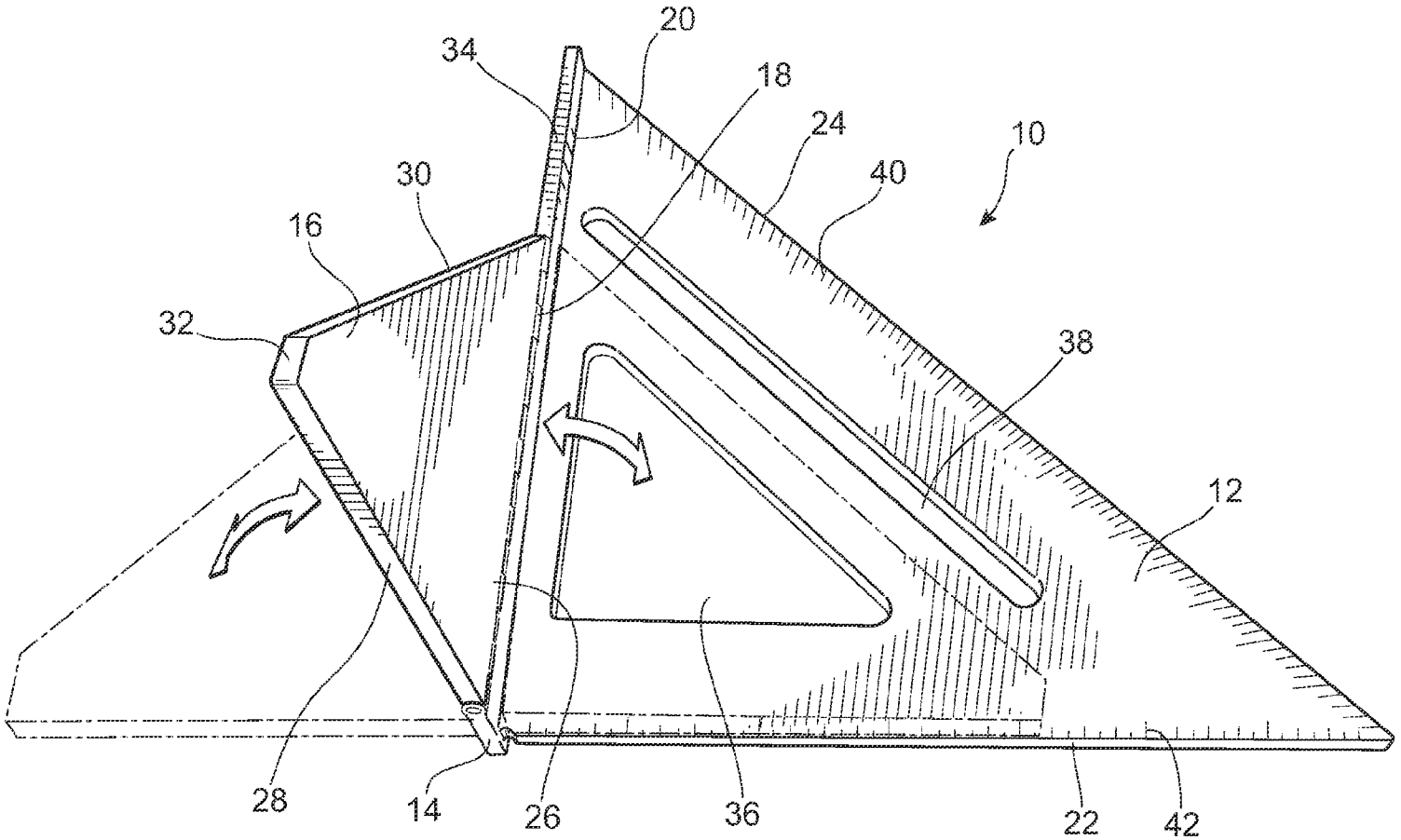
FIG. 2 is an inverted perspective view of the framing square of FIG. 1, also showing the framing square in the open position of FIG. 1, and a portion of the framing square shown in phantom in an alternate open position.
Figure 3:
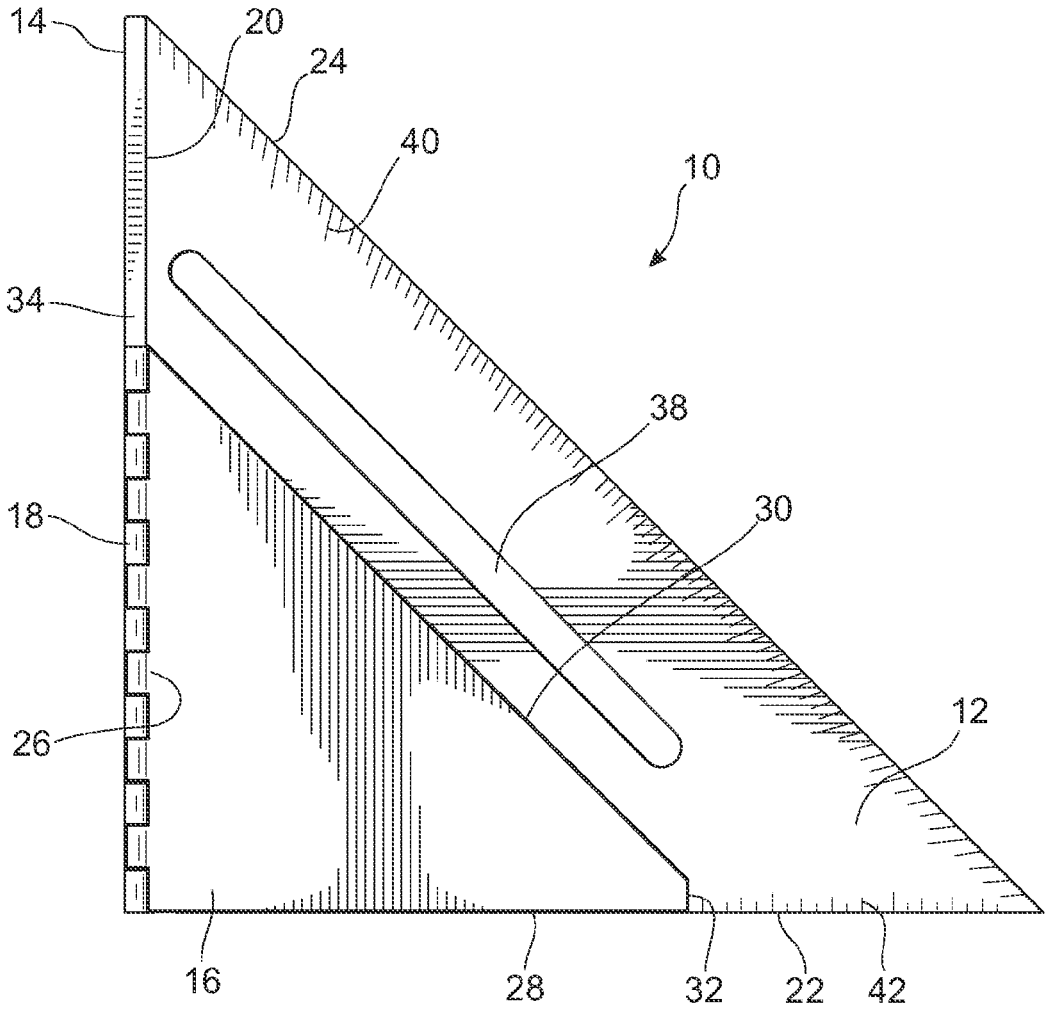
FIG. 3 is a plan view of the framing square of FIG. 1, showing the framing square in a closed position.
Figure 4:
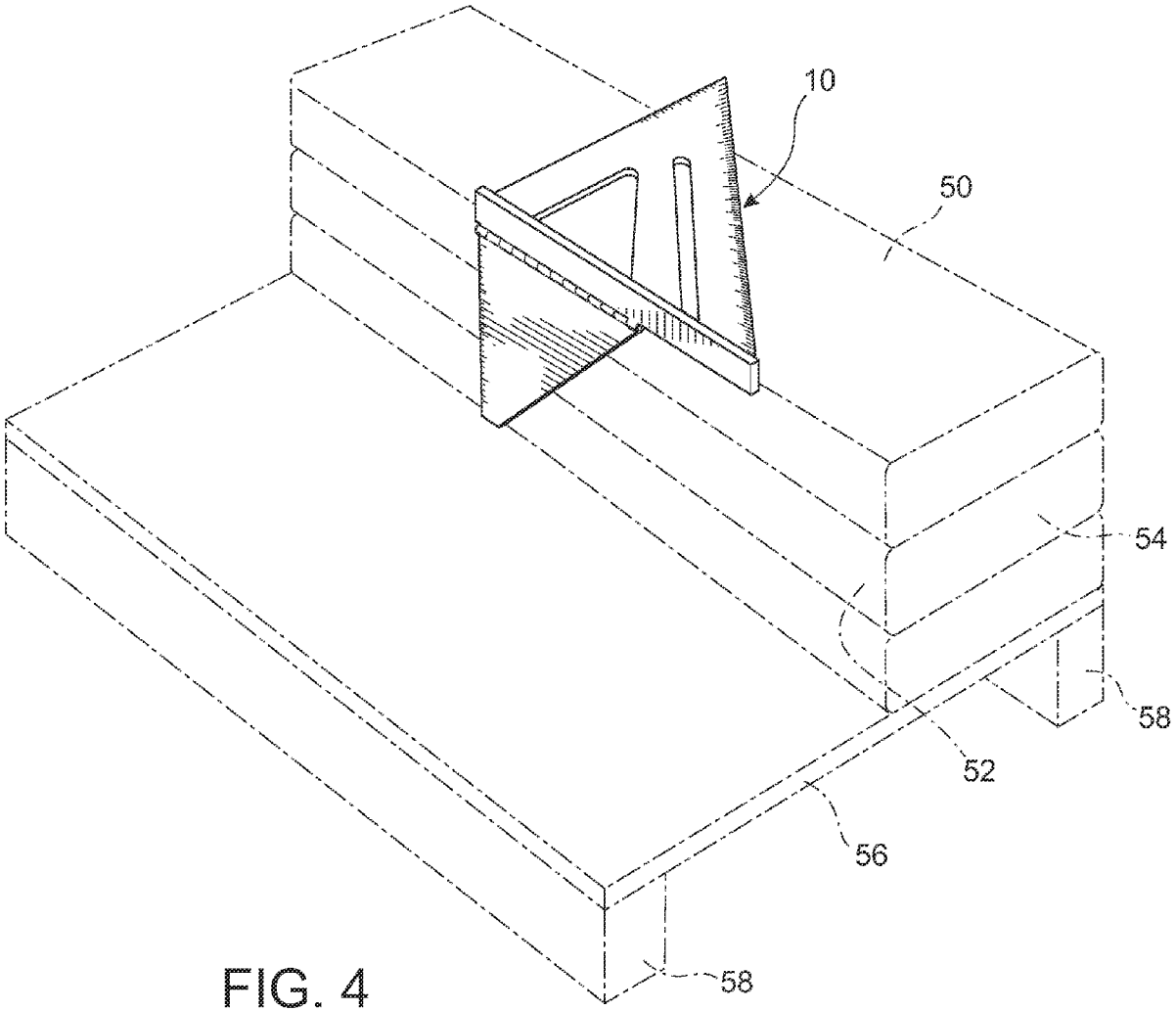
FIG. 4 is a perspective view of the framing square of FIG. 1, showing the framing square mounted on a plate to be measured and marked.
Figure 5:
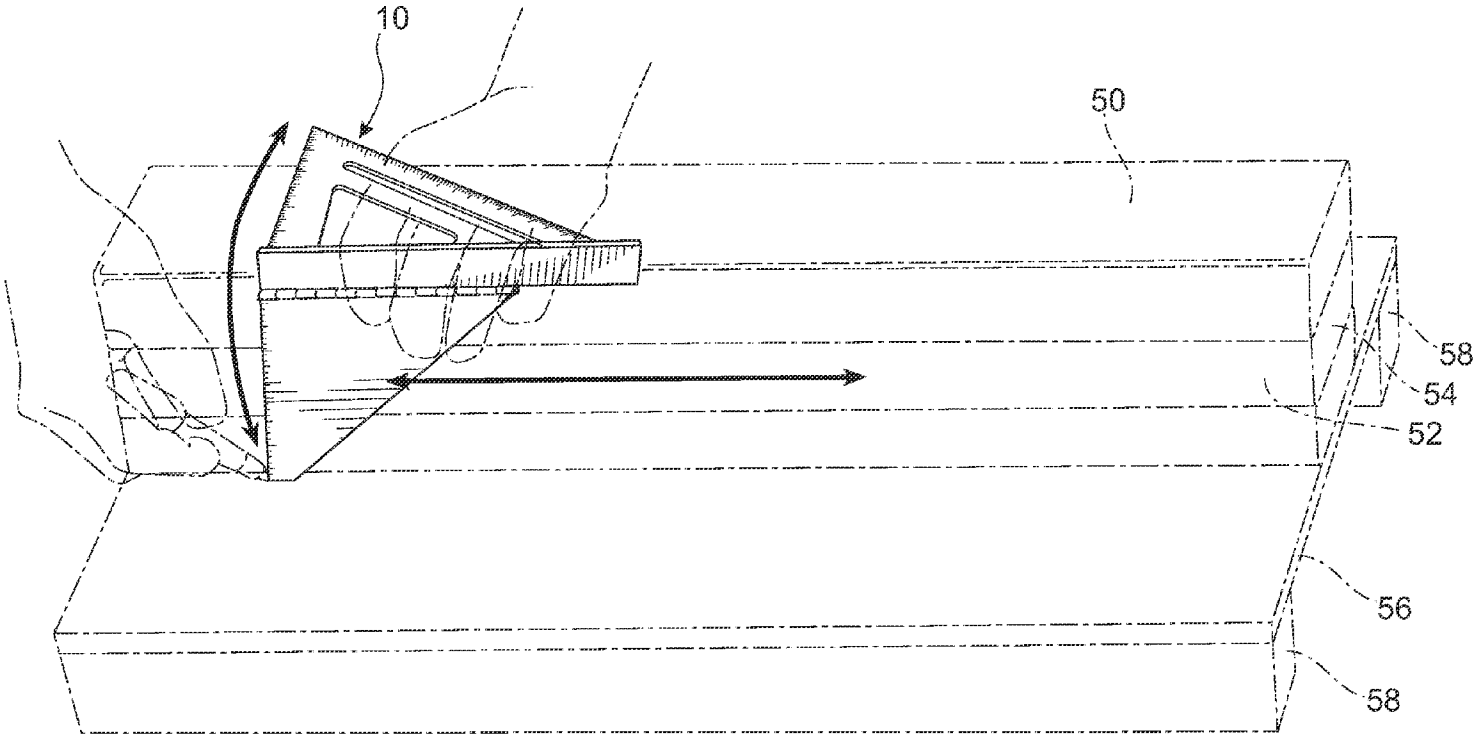
FIG. 5 is a perspective view of the framing square of FIG. 1, showing the plate of FIG. 4 being marked with a first set of markings.
Figure 6:
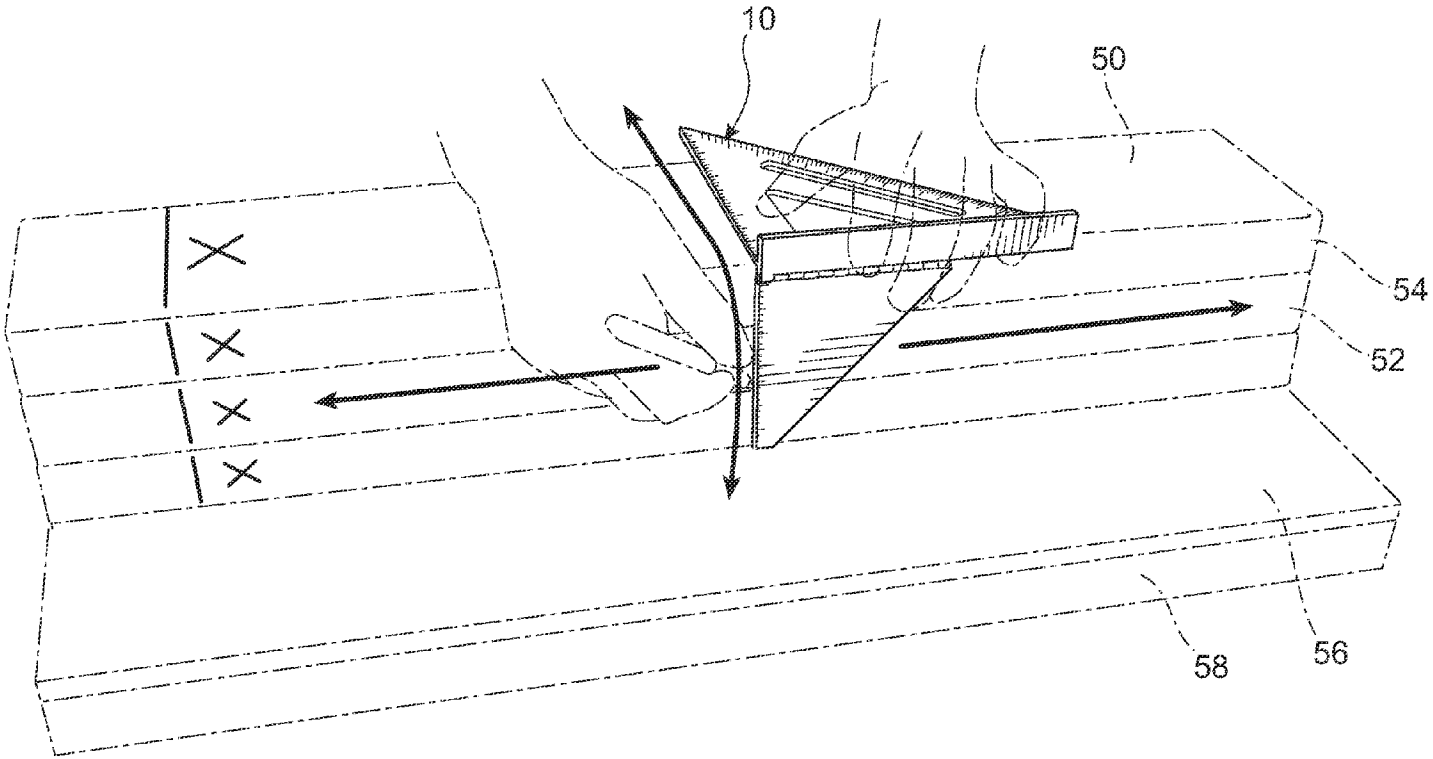
FIG. 6 is a perspective view of the framing square of FIG. 1, showing the plate of FIG. 4 being marked with a second set of markings.
Figure 7:
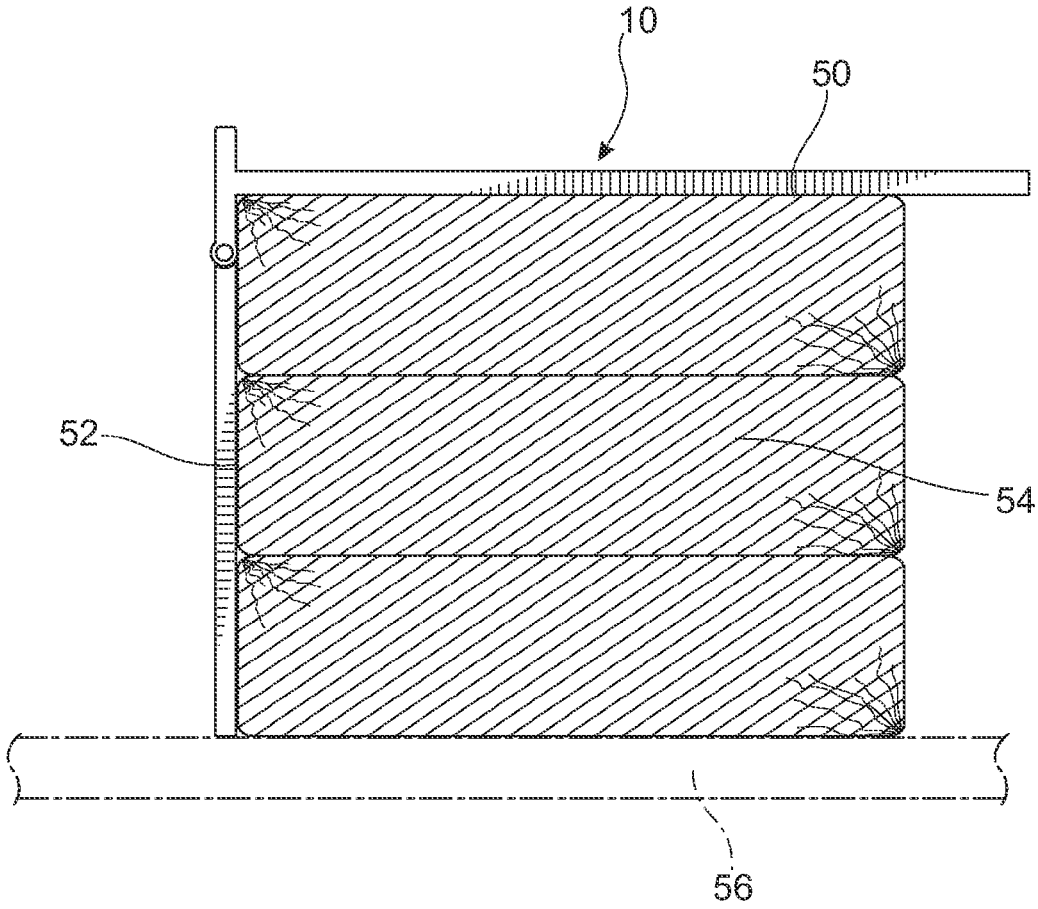
FIG. 7 is a side view of the framing square of FIG. 1, showing the framing square mounted on the plate of FIG. 4 with a section view of the plate.

FIGS. 1-7 show an embodiment of the present invention, a framing square 10 for measuring and marking building materials and the like. The framing square 10 has a first square 12, which has a flange 14 attached to and substantially perpendicular to the first square 12 forming a substantially "T" shaped section therewith, and a second square 16 hingedly attached to the flange 14 at hinge 18, the hinge preferably being integral with both the flange 14 and the second square 16, as best shown in FIGS. 1-3.

The first square 12 has a substantially triangular shaped outer periphery, having first leg 20, second leg 22, and hypotenuse 24, the first leg 20 being substantially perpendicular to the second leg 22. The flange 14 is attached to, but preferably integral with, the first leg 20 of the first square 12 with a major portion of the flange 14 substantially collinear with the first leg 20 and the minor portion of the flange 14 substantially perpendicular to the first leg 20, the flange 14 forming a substantially T shape with the first square 12.

The first square 12 typically has a right triangular shape, but may optionally be of an alternate shape, such as, for example, a right-angled trapezium shape, rectangular shape, or other suitable shape. The flange 14 attached to and substantially perpendicular to the first square 12 forms a substantially "T" shaped section therewith; however, the flange may optionally have an alternative shape, and form, for example, an "L" shape section or an offset "T" shape section with the first square 12.

The second square 16 is shown as a right-angled trapezium having a third leg 26 and a fourth leg 28 substantially perpendicular to one another, a major leg 30, and a minor leg 32 substantially parallel to the third leg 26. The third leg 26 of the second square 16 is hingedly attached to the flange 14 at the hinge 18, which is preferably integral with the third leg 26 of the second square 16 at edge 34 of the flange 14. The second square 16 may optionally be of an alternate shape, such as, for example, a right triangle shape, rectangular shape, or other suitable shape.

The first square 12 of the framing square 10 has cutouts 36 and 38 having indicia at edges thereof to facilitate auxiliary measurements. The second square 16 may also optionally have cutouts for auxiliary measurements. The first square 12 and the second square 16 have scales 40, 42, and 44 marked in increments to facilitate measurement and marking.

The hinge 18 allows a user to open the framing square 10 for measurement and marking of building materials, such as, for example a top 50 and front 52 of a plate 54 or sill plate, as shown in FIGS. 4-7, or other suitable object, rapidly in one or more strokes without the need to move or reposition the framing square 10. The user may repeat the measurement and marking of the tops and fronts of the building materials, plates, sill plates, and the like, at suitable distances quickly and easily for, for example, the placement of studs, by sliding the framing square 10 along the length of the building materials, plates, sill plates, and the like, without lifting the framing square from the materials being measured and marked. The framing square 10 may be closed for carrying and/or storage, when not in use. FIGS. 4-7 also show the plate 54 fastened to a floor or subfloor 56, which is fastened to joists 58 or other support structure.

The framing square 10 may be of metal, such as aluminum or steel, thermoplastics, thermosetting polymers, rubber, wood, or other suitable material or combination thereof.

Figure 8:
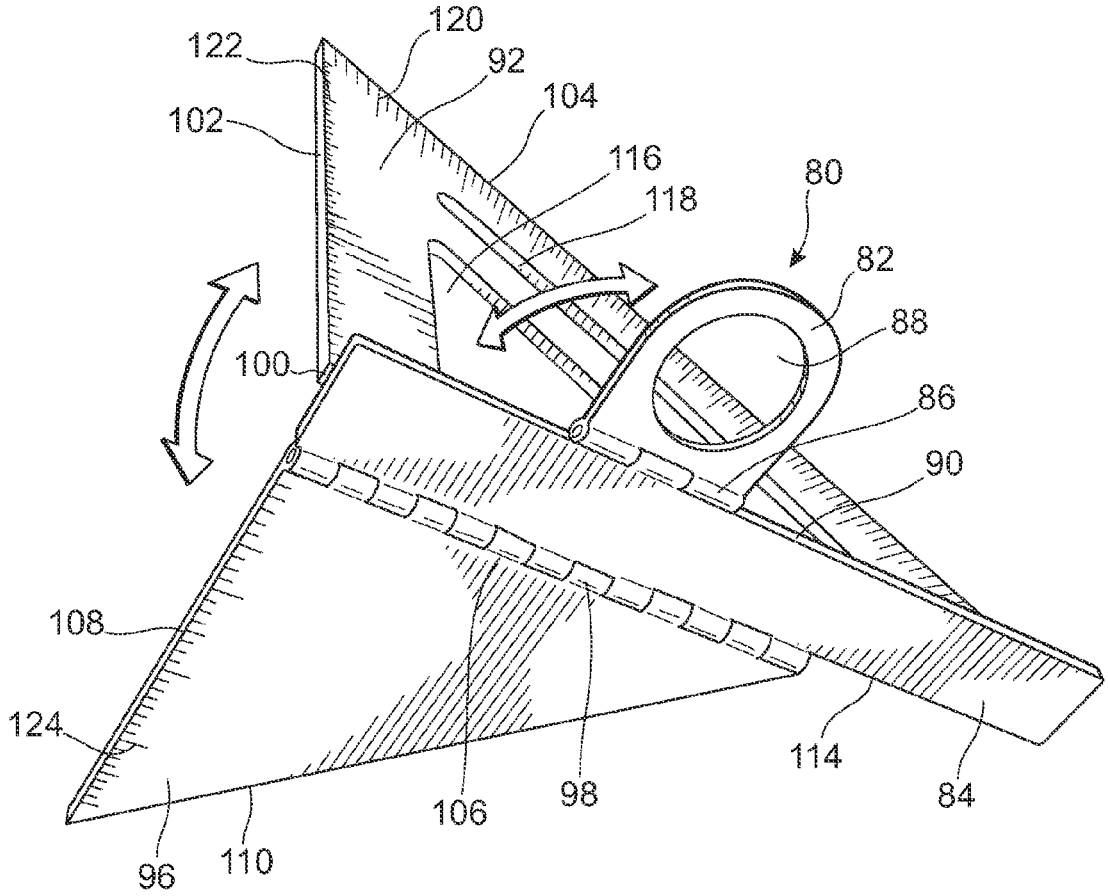
FIG. 8 is a perspective view of an alternate embodiment of the framing square of FIG. 1, constructed in accordance with the present invention, showing the framing square of FIG. 8 in an open position and a grip of the framing square of FIG. 8 also in an open position and ready for use by a user.
Figure 9:
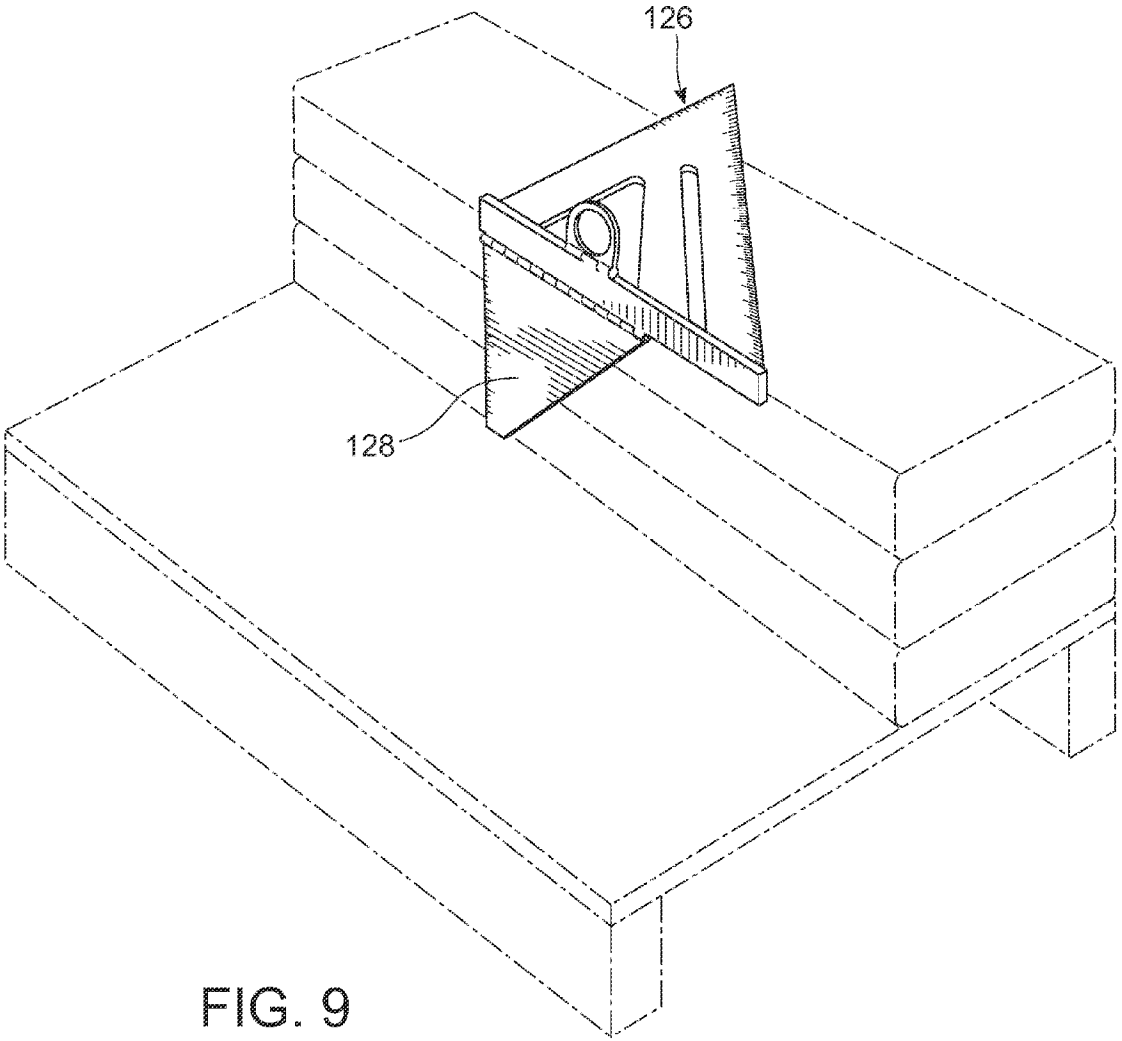
FIG. 9 is a perspective view of an alternate embodiment of the framing square of FIG. 8, showing the framing square mounted on another plate to be measured and marked.
Figure 10:
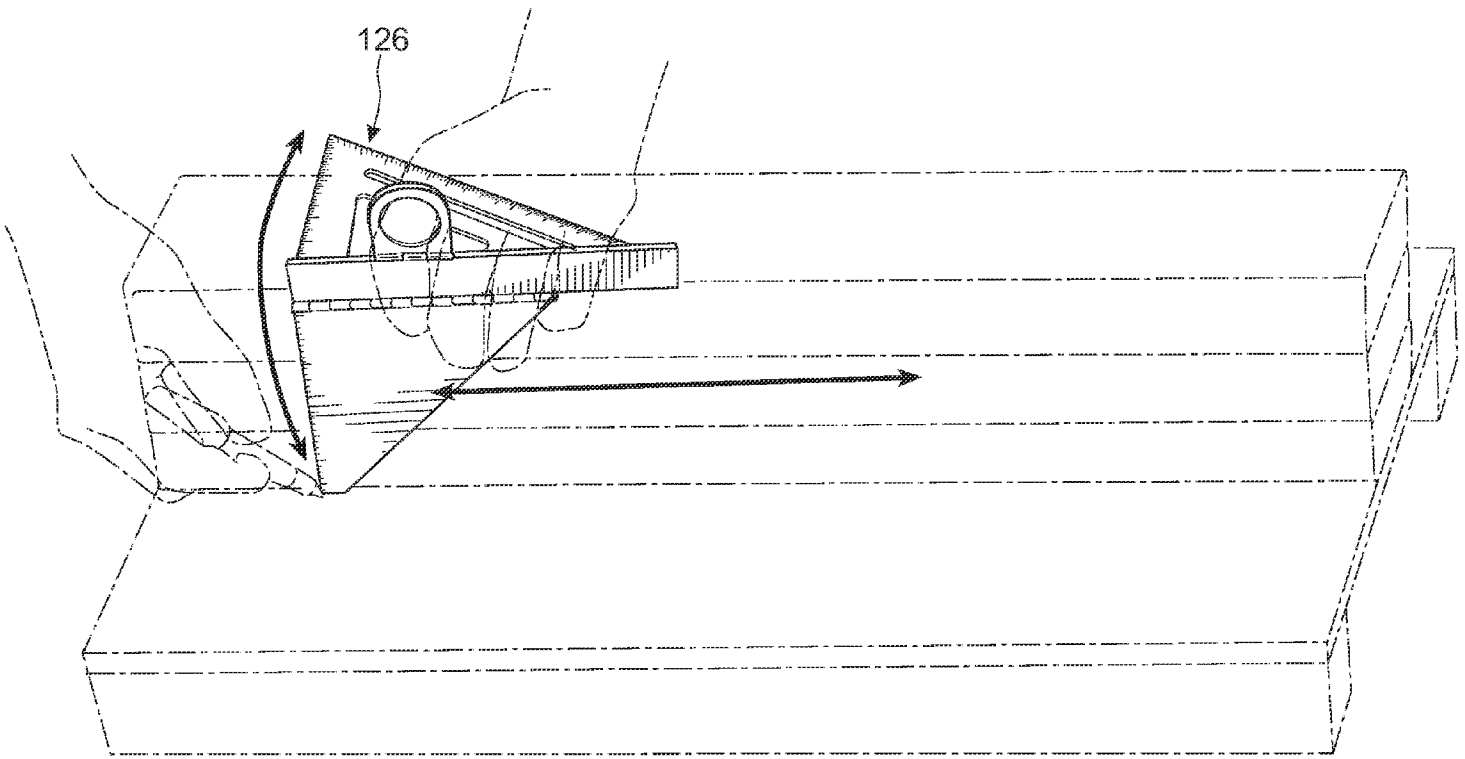
FIG. 10 is a perspective view of the framing square of FIG. 9, showing the plate of FIG. 9 being marked with another first set of markings.
Figure 11:
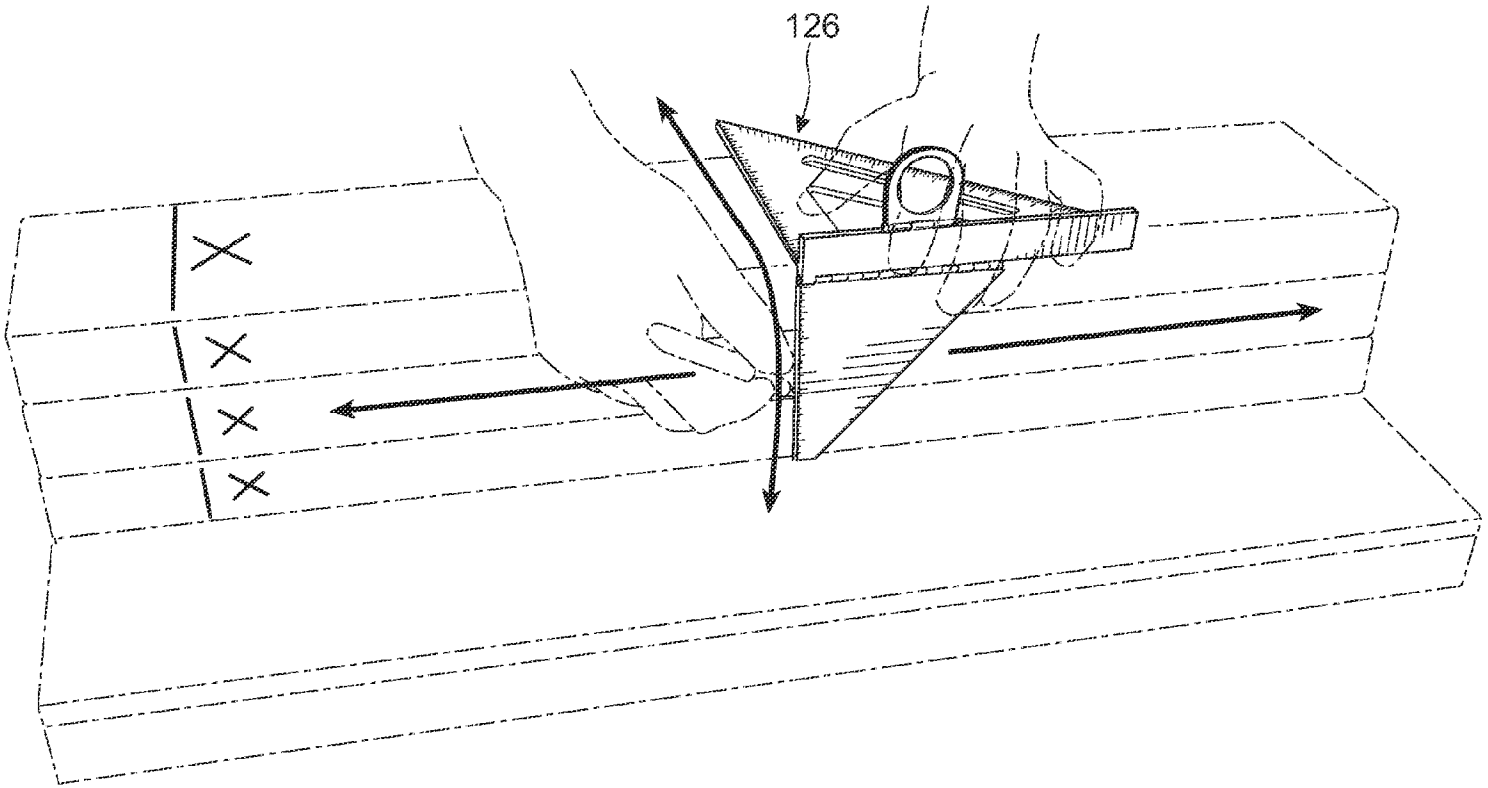
FIG. 11 is a perspective view of the framing square of FIG. 9, showing the plate of FIG. 9 being marked with another second set of markings.
Figure 12:
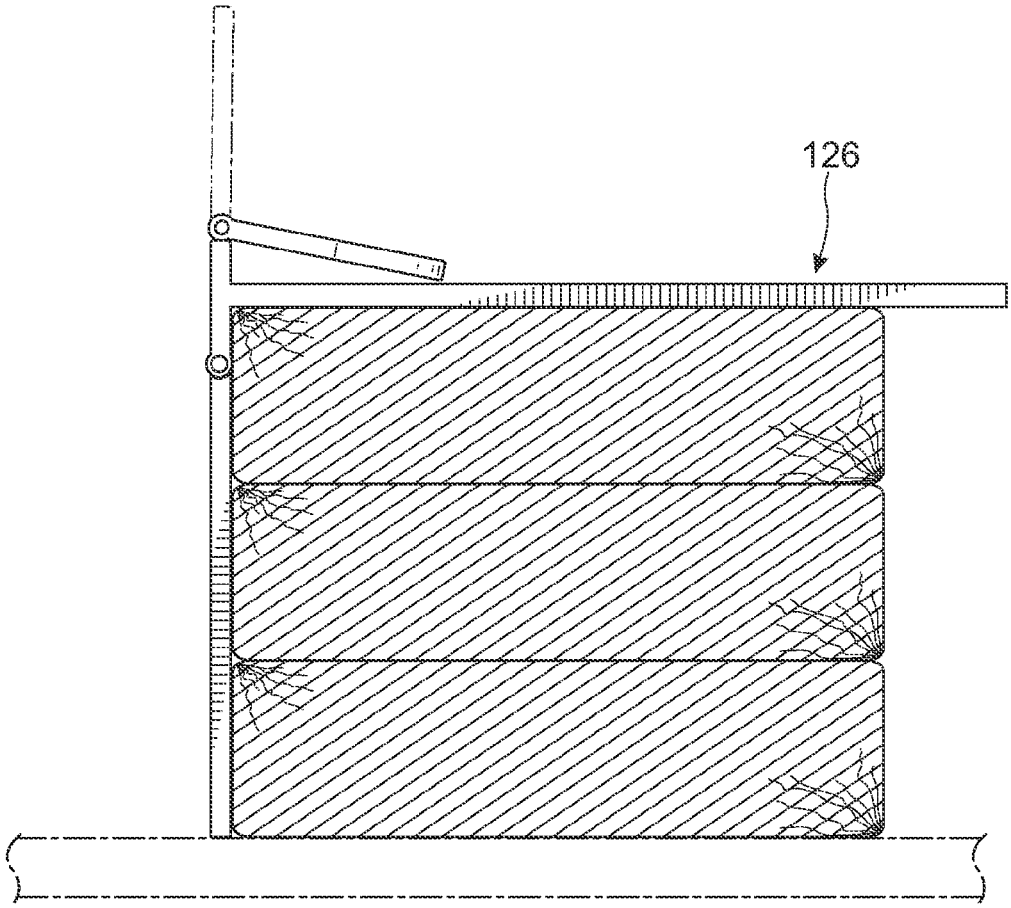
FIG. 12 is a side view of the framing square of FIG. 9, showing the framing square mounted on the plate of FIG. 9 with a section view of the plate.
Figure 14:
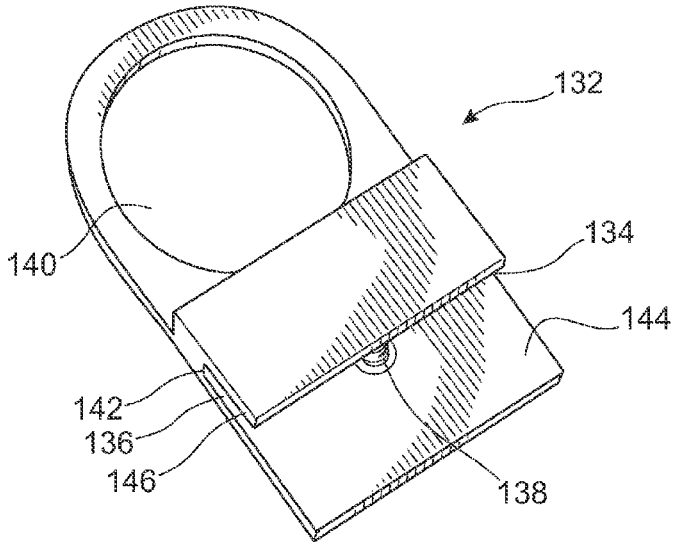
FIG. 14 is a perspective view of the portion of the framing square shown in phantom in FIG. 13.
Figure 13:
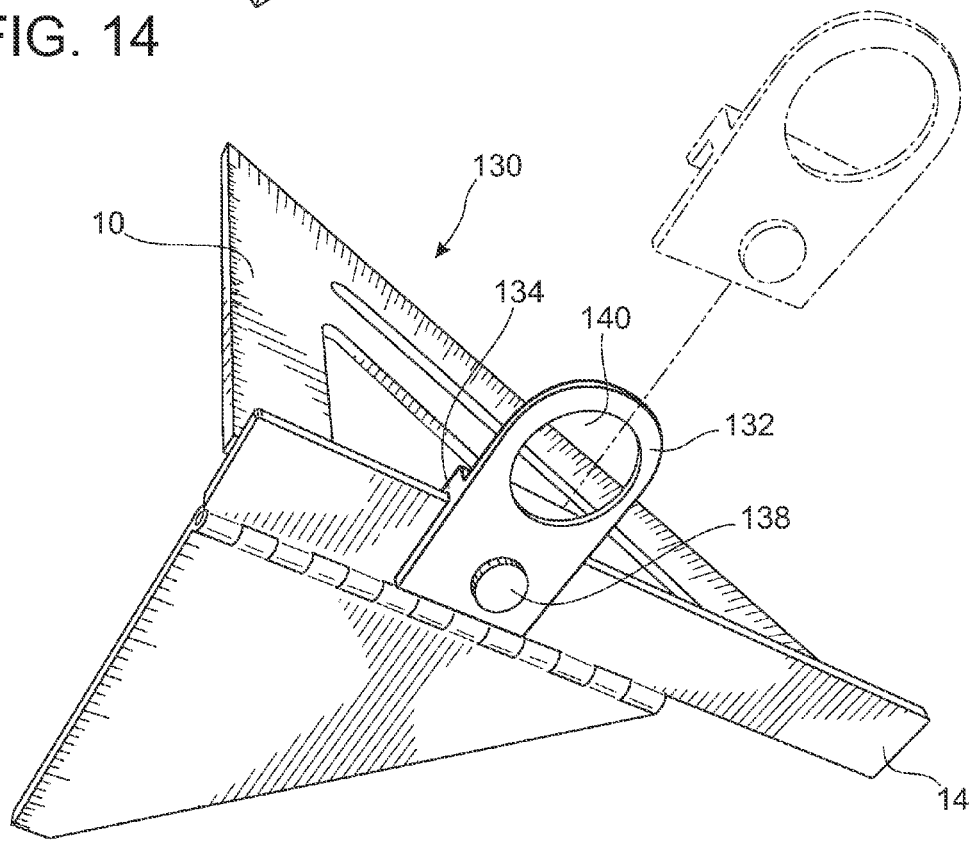
FIG. 13 is a perspective view of an alternate embodiment of a framing square, constructed in accordance with the present invention, showing the framing square in an open position and showing a portion of the framing square in phantom.
Figure 15:
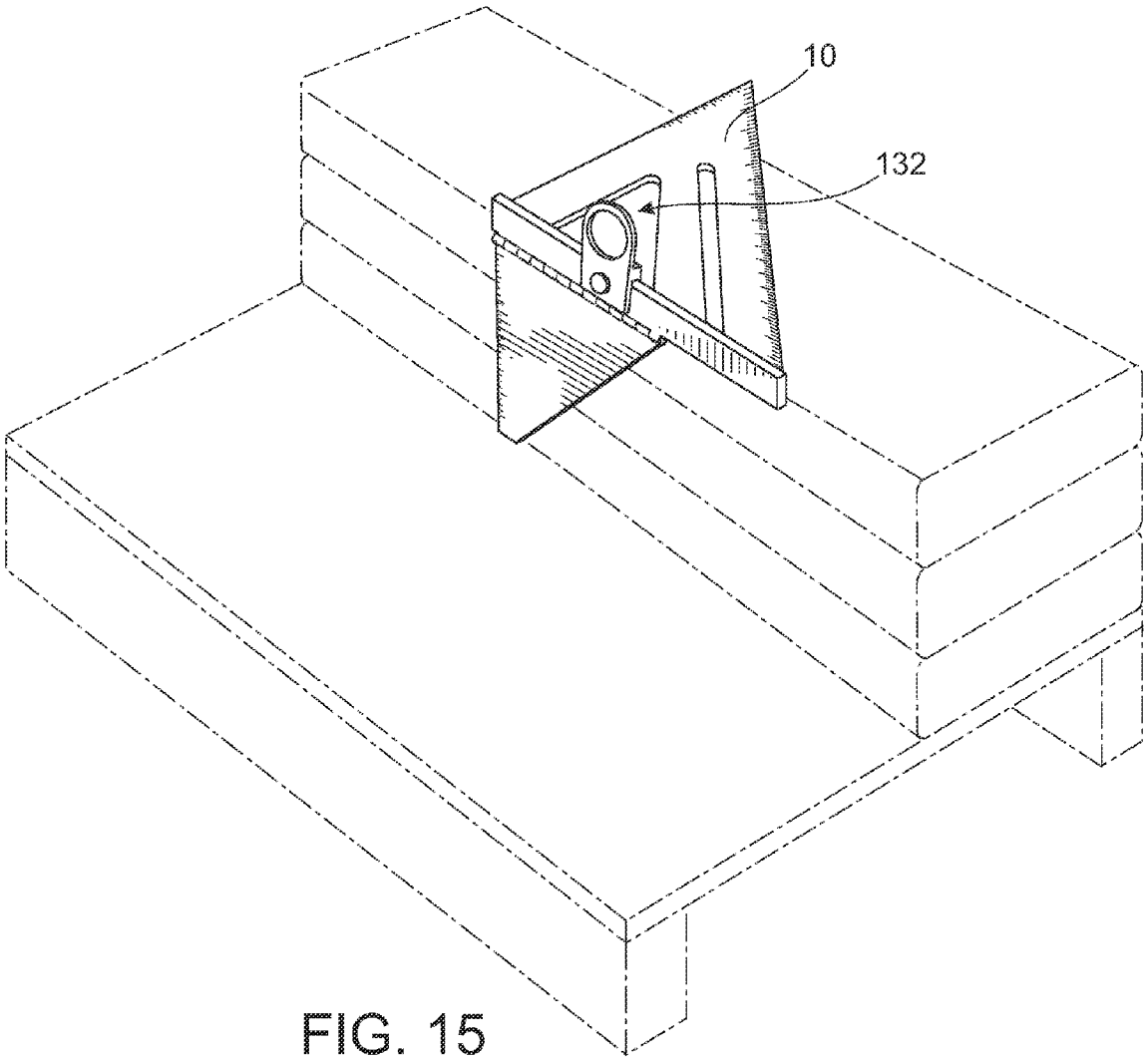
FIG. 15 is a perspective view of the framing square of FIG. 13, showing the framing square mounted on yet another plate to be measured and marked.
Figure 16:
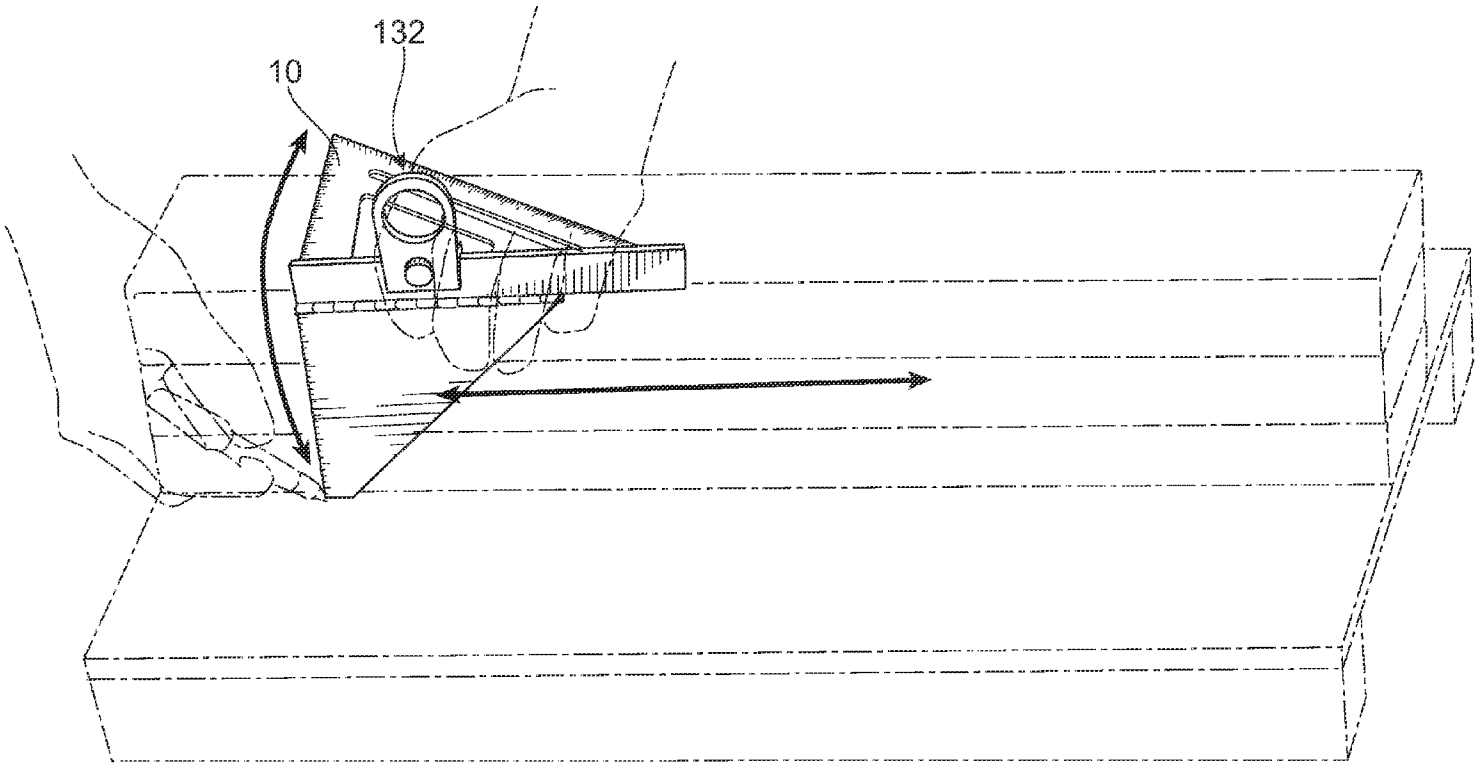
FIG. 16 is a perspective view of the framing square of FIG. 13, showing the plate of FIG. 15 being marked with yet another first set of markings.
Figure 17:
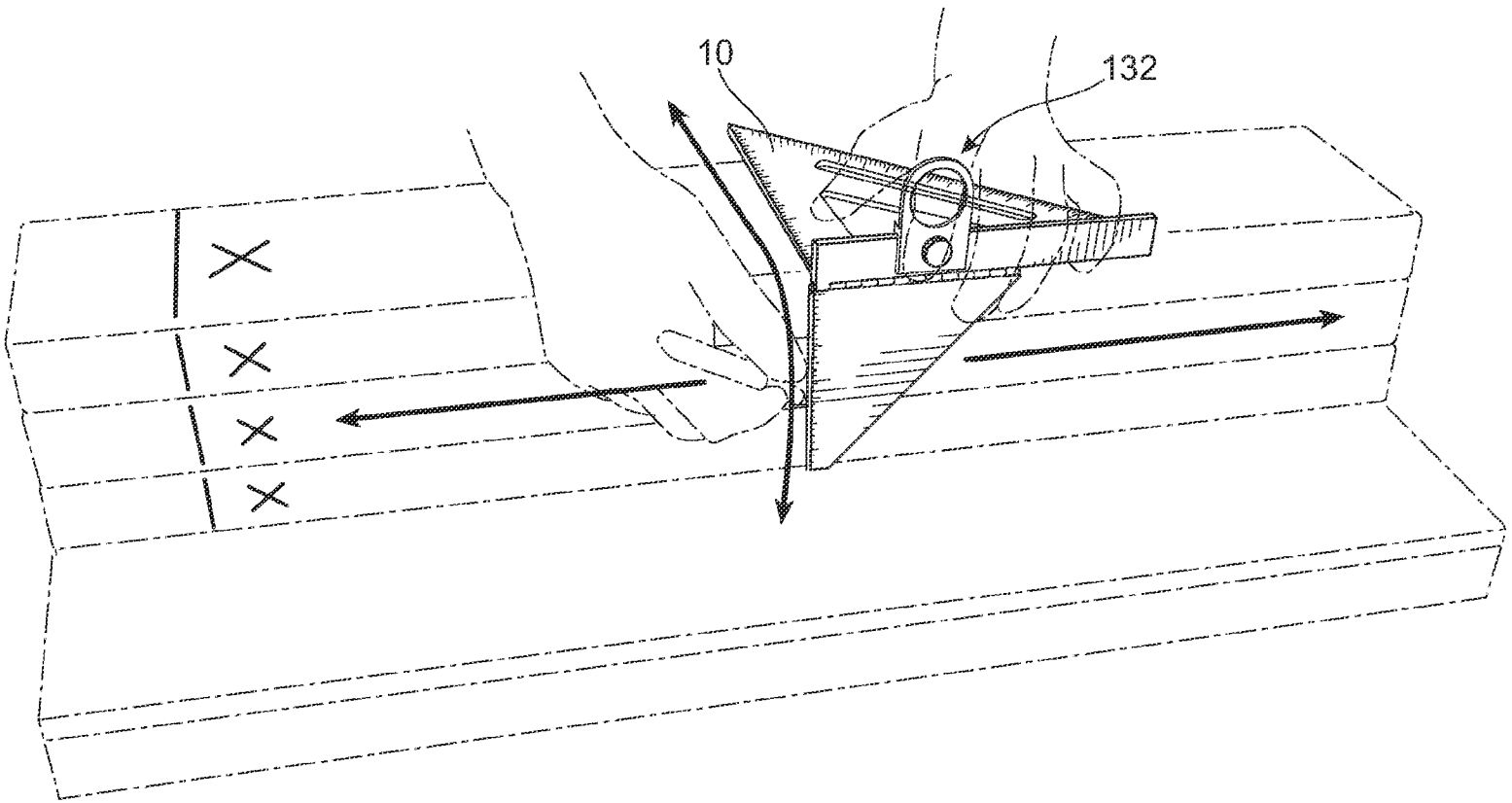
FIG. 17 is a perspective view of the framing square of FIG. 13, showing the plate of FIG. 15 being marked with yet another second set of markings.

FIG. 8 shows an alternate embodiment of a framing square 80, which is substantially the same as the framing square 10, except that the framing square 80 has tab shaped ring 82 hingedly attached to flange 84 at first hinge 86, the tab shaped ring 82 having hole 88 therethrough, and is adapted to facilitate a user holding the framing square 80, such as, for example, by inserting a finger therethrough. The first hinge 86 has a portion which is preferably integral with the tab shaped ring 82 and another portion which is preferably integral with the flange 84 at first edge 90 of the flange 84.

The tab shaped ring 82 hingedly attached to the flange 84 allows the tab shaped ring 82 to fold from an open to a closed position and vice versa.

The framing square 80 has a first square 92 and a second square 96 hingedly attached to the flange 84 at second hinge 98, the first hinge 86 opposing the second hinge 98, the second hinge 98 preferably integral with both the flange 84 and the second square 96. The flange 84 is attached to the first square 92, and forms a substantially "T" shaped section therewith. The tab shaped ring 82 and the second square 96 are opposingly and hingedly attached to the flange 84.

The first square 92 has a substantially triangular shaped outer periphery, having first leg 100, second leg 102, and hypotenuse 104, the first leg 100 being substantially perpendicular to the second leg 102. The flange 84 is attached to, but preferably integral with, the first leg 100 of the first square 92 with a major portion of the flange 84 substantially collinear with the first leg 100 and a minor portion of the flange 84 substantially perpendicular to the first leg 100, the flange 84 forming a substantially T shape with the first square 92.

The first square 92 typically has a right triangular shape, but may optionally be of an alternate shape, such as, for example, a right-angled trapezium shape, rectangular shape, or other suitable shape. The flange 84 attached to and substantially perpendicular to the first square 92 forms a substantially "T" shaped section therewith; however, the flange may optionally have an alternative shape, and form, for example, an "L" shape section or an offset "T" shape section with the first square 92.

The second square 96 is shown as having a substantially triangular shape, having a third leg 106, a fourth leg 108, and a hypotenuse 110, the third leg 106 and the fourth leg 108 being substantially perpendicular to one another. The third leg 106 of the second square 96 is hingedly attached to the flange 84 at the second hinge 98, which is preferably integral with the third leg 106 of the second square 96 at second edge 114 of the flange 84. The second square 96 may optionally be of an alternate shape, such as, for example, a right-angled trapezium, rectangular shape, or other suitable shape.

The first square 92 of the framing square 80 has cutouts 116 and 118 having indicia at edges thereof to facilitate auxiliary measurements. The second square 96 may also optionally have cutouts for auxiliary measurements. The first square 92 and the second square 96 have scales 120, 122, and 124 marked in increments to facilitate measurement and marking.

FIGS. 9-12 show an alternate embodiment of a framing square 126, which is substantially the same as the framing square 80, except that the framing square 126 has a right-angled trapezium shaped second square 128.

FIGS. 13-17 show an alternate embodiment of a framing square 130, which is substantially the same as the framing square 10, except that the framing square 130 has tab shaped ring 132 having clamp 134, which includes substantially "U" shaped channel 136 for matingly and removably receiving a portion of a framing square therein, such as, for example, for matingly and removably receiving the flange 14 of the framing square 10 therein or for matingly and removably receiving a portion of another suitable framing square. The tab shaped ring 132 has fastener 138 adapted to removably fasten the tab shaped ring 132 to the flange 14 of the framing square 10 or other suitable framing square. The tab shaped ring 132 has hole 140, and is adapted to facilitate a user holding the framing square 130, such as, for example, by inserting a finger therethrough The substantially "U" shaped channel 136 is formed by a channel base 142 attached to a major portion 144 of the tab shaped ring 132 and a side portion 146 attached to the channel base 142.

The tab shaped ring 132 may optionally have a hinge, which hingedly attaches the portion of the tab shaped ring 132 having the hole 140 to the major portion 144 of the tab shaped ring 132, thus, allowing the tab shaped ring 132 having the hole 140 and the major portion 144 of the tab shaped ring 132 to fold from an open to a closed position and vice versa.

Figure 18:
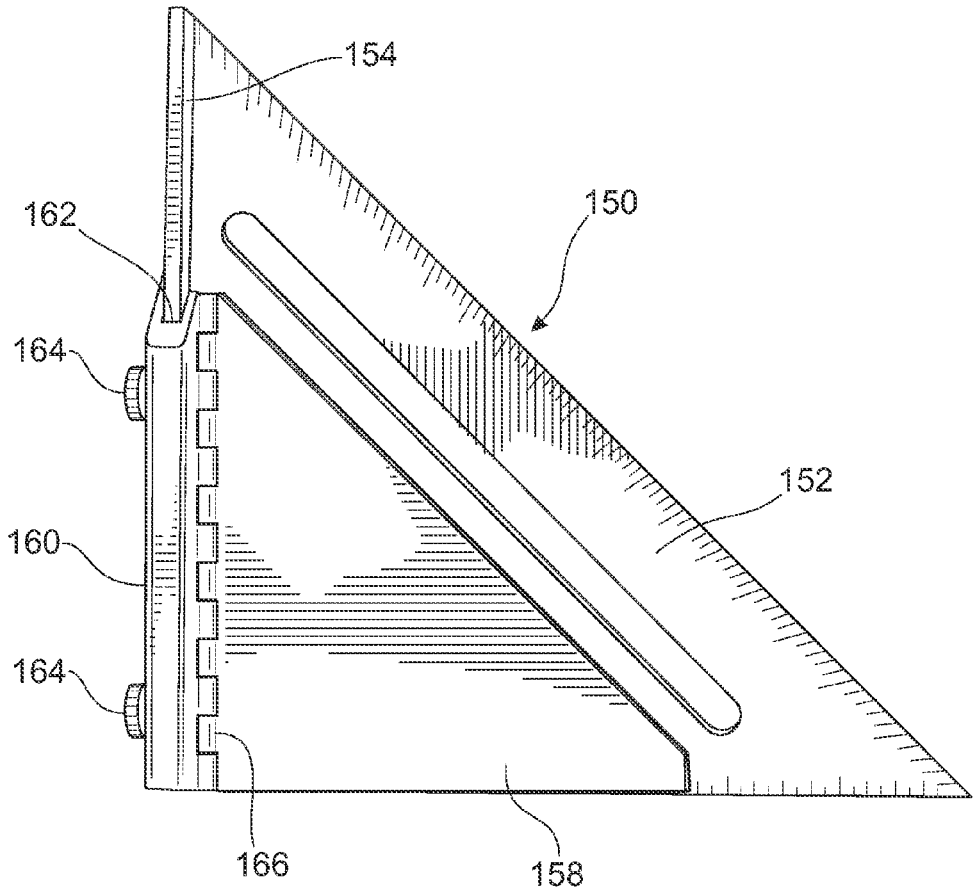
FIG. 18 is a perspective view of an alternate embodiment of a framing square, constructed in accordance with the present invention, showing the framing square in a closed position.
Figure 19:
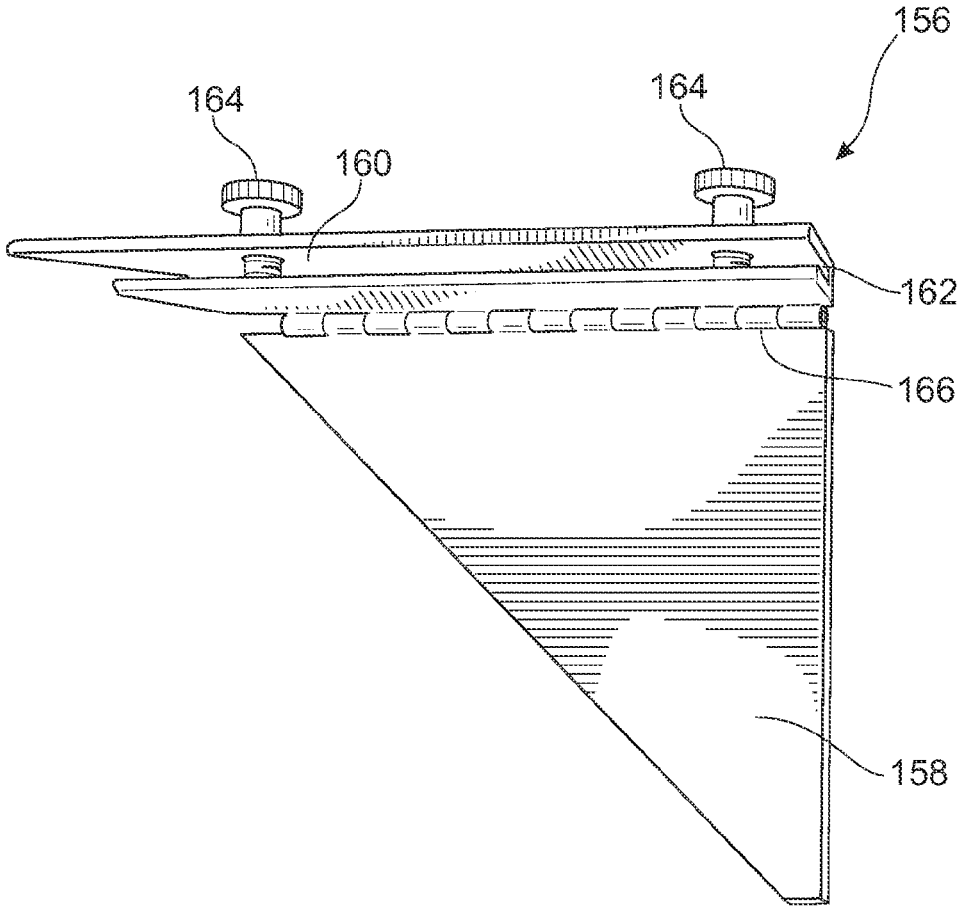
FIG. 19 is perspective view of a portion of the alternate embodiment of the framing square of FIG. 18.
Figure 20:
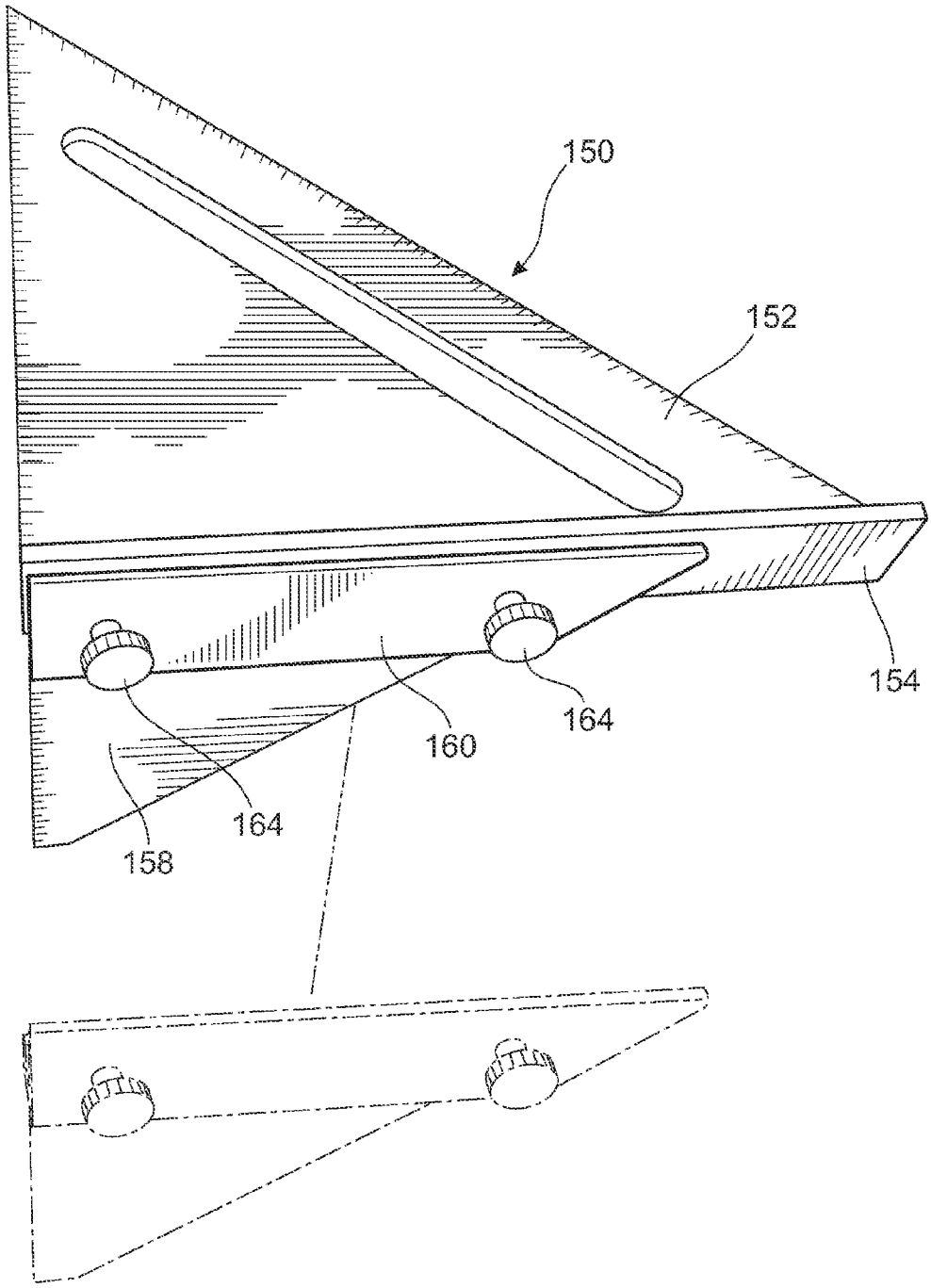
FIG. 20 is a perspective view of the alternate embodiment of the framing square of FIG. 18, also showing the portion of the framing square of FIG. 19 in phantom.
Figure 21:
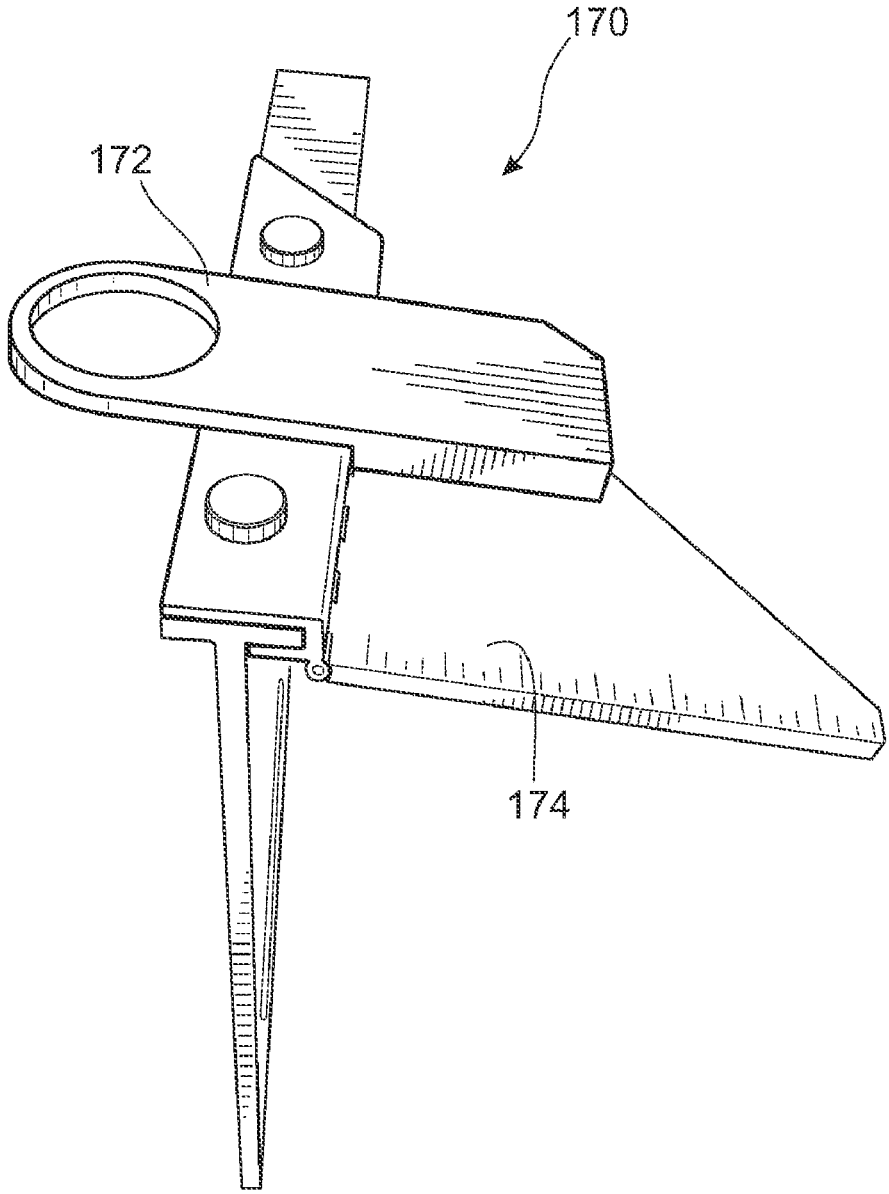
FIG. 21 is a perspective view of an alternate embodiment of a framing square, constructed in accordance with the present invention, showing the framing square in an open position.
Figure 22:
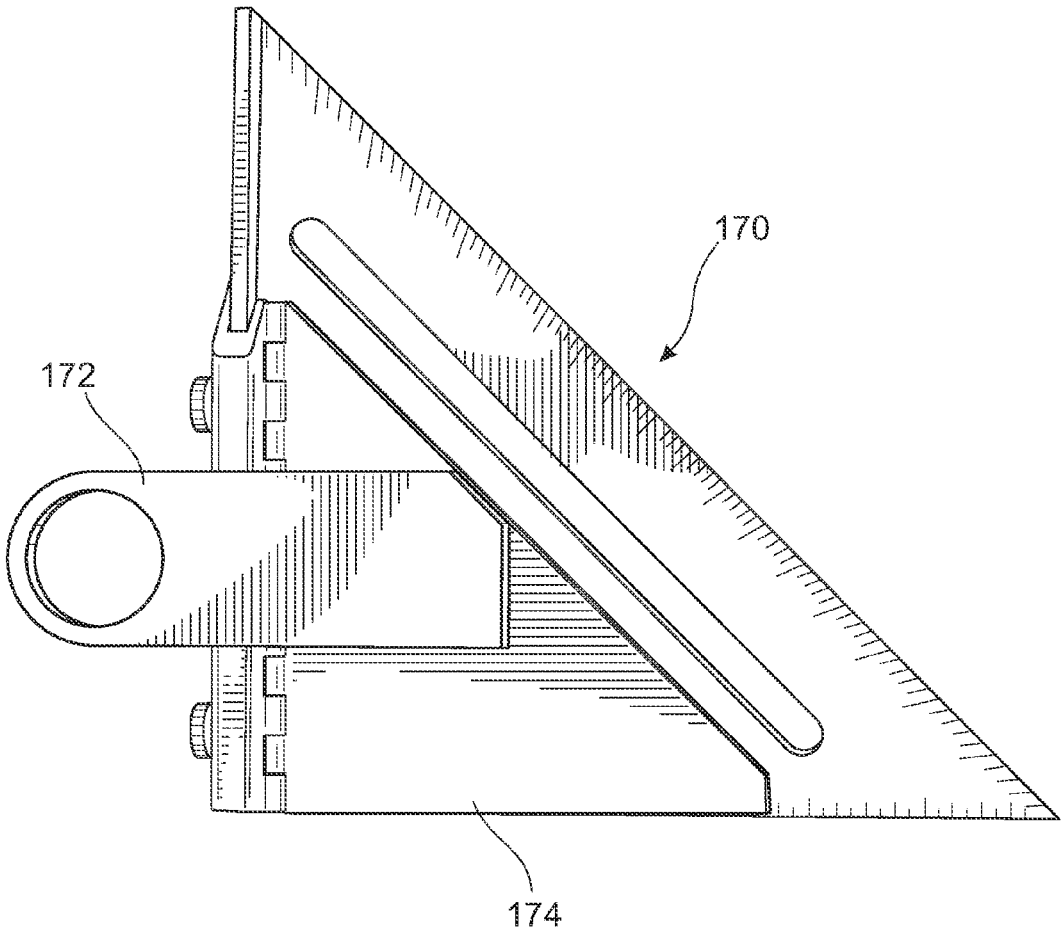
FIG. 22 is another perspective view of the framing square of FIG. 21, showing the framing square in a closed position.
Figure 23:
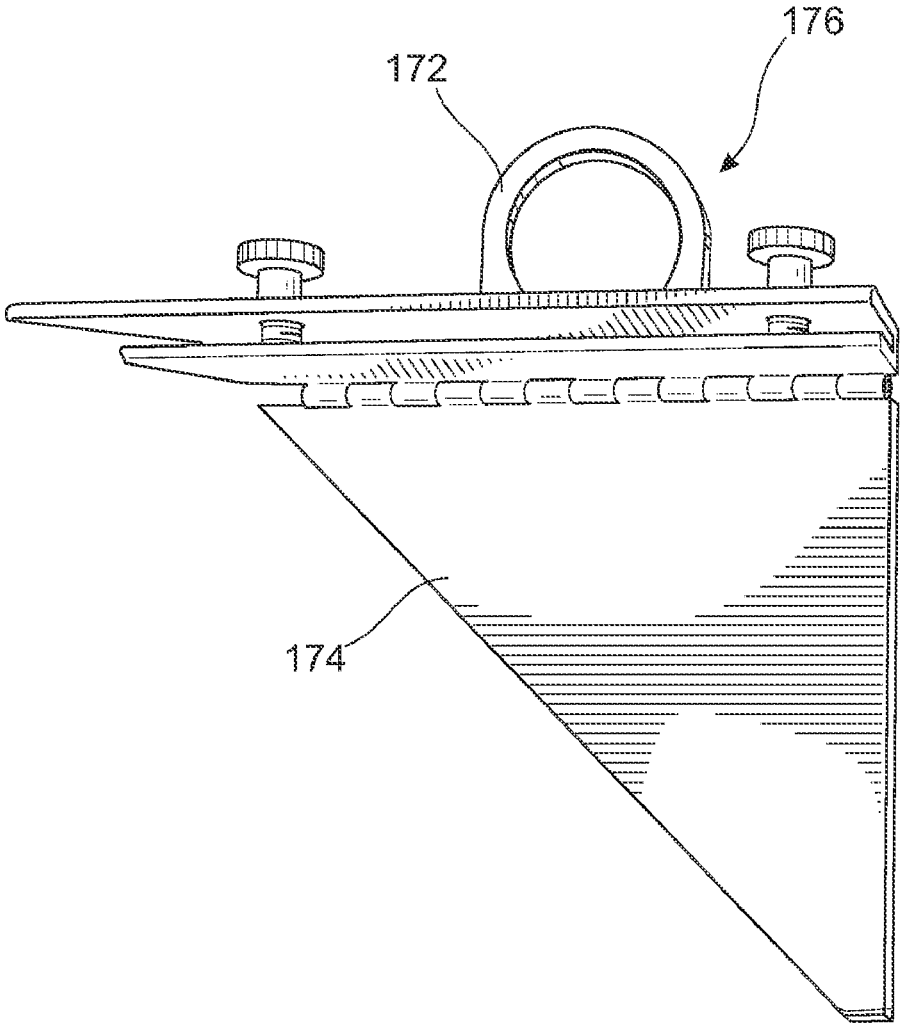
FIG. 23 is perspective view of a portion of the alternate embodiment of the framing square of FIG. 21.
Figure 24:
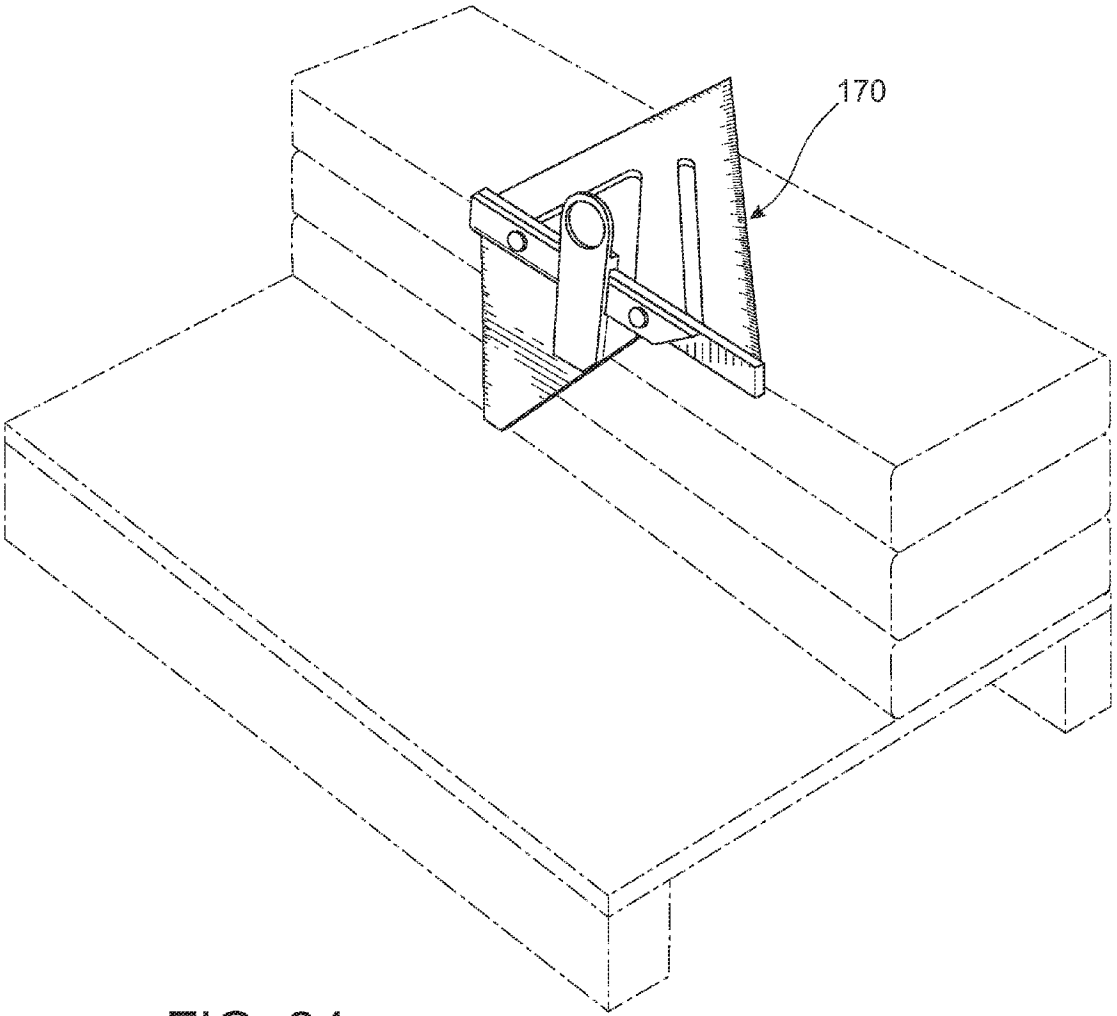
FIG. 24 is a perspective view of the framing square of FIG. 21, showing the framing square mounted on yet another plate to be measured and marked.

FIGS. 18-20 show an alternate embodiment of a framing square 150, which is substantially the same as the framing square 10, except that the framing square 150 has a first square 152 having a flange 154 and a hinged square 156 having a second square 158 hingedly attached to a clamp 160, which may be removably and releasably clamped to the flange 154 or removably and releasably attached to a portion of another suitable framing square. The clamp 160 has substantially "U" shaped channel 162 adapted to matingly and removably attach to the flange 154 or a portion of another suitable framing square and fasteners 164 adapted to releasably fasten the clamp 160 to the flange 154 or a portion of another suitable framing square. The second square 158 is hingedly attached to the clamp 160 at hinge 166.

The first square 152 typically has a right triangular shape, but may optionally be of an alternate shape, such as, for example, a right-angled trapezium shape, rectangular shape, or other suitable shape. The flange 154 attached to and substantially perpendicular to the first square 152 forms a substantially "T" shaped section therewith; however, the flange may optionally have an alternative shape, and form, for example, an "L" shape section or an offset "T" shape section with the first square 152. The second square 158 may optionally have a right-angled trapezium shape, a right triangle shape, a rectangular shape, or other suitable shape.

FIGS. 21-24 show an alternate embodiment of a framing square 170, which is substantially the same as the framing square 150, except that the framing square 170 has a tab shaped ring 172 fastened to first square 174 of hinged square 176 of the framing square 170. The tab shaped ring 172 is adapted to facilitate a user holding the framing square 170, such as, for example, by inserting a finger therethrough. The tab shaped ring 172 may alternatively be hingedly fastened to the first square 174 or alternatively hingedly fastened to the clamp 160.

Although the present invention has been described in considerable detail with reference to certain preferred versions thereof, other versions are possible. Therefore, the spirit and scope of the appended claims should not be limited to the description of the preferred versions contained herein.

What is claimed is:

1. A folding framing square, comprising:

a substantially right triangular shaped framing square having a flange attached substantially perpendicular thereto and forming a substantially "T" shaped section therewith;

a substantially right-angled trapezium shaped framing square hingedly attached to said flange of said substantially right triangular shaped framing square.

2. The folding framing square according to claim 1, further comprising:

a ring hingedly attached to said flange of said substantially right triangular shaped framing square.

3. The folding framing square according to claim 2, wherein:

said flange has opposing edges, said ring and said right-angled trapezium shaped framing square are opposingly and hingedly attached to said opposing edges of said flange.

4. The folding framing square according to claim 3, wherein said ring hingedly attached to said flange is adapted to removably receive a finger of a user therethrough.

5. The folding framing square according to claim 1, further comprising:

a ring attached to a clamp adapted to allow said clamp to be removably and releasably attached to said flange, said ring adapted to removably receive a finger of a user therethrough.

6. The folding framing square according to claim 1, further comprising:

a ring hingedly attached to a clamp, said clamp adapted to allow said clamp to be removably and releasably attached to said flange, said ring adapted to removably receive a finger of a user therethrough.

7. A folding framing square, comprising:

a first substantially right triangular shaped framing square having a flange attached substantially perpendicular thereto and forming a substantially "T" shaped section therewith;

a second substantially right triangular shaped framing square hingedly attached to said flange of said first substantially right triangular shaped framing square.

8. The folding framing square according to claim 7, further comprising:

a ring hingedly attached to said flange of said first substantially right triangular shaped framing square.

9. The folding framing square according to claim 7, further comprising:

a ring hingedly attached to said flange of said first substantially right triangular shaped framing square, said ring hingedly attached to said flange is adapted to removably receive a finger of a user therethrough.

10. The folding framing square according to claim 9, wherein:

said flange has opposing edges, said ring and said first substantially right triangular shaped framing square are opposingly and hingedly attached to said opposing edges of said flange.

11. The folding framing square according to claim 7, further comprising:

a ring attached to a clamp adapted to allow said clamp to be removably and releasably attached to said flange, said ring adapted to removably receive a finger of a user therethrough.

12. The folding framing square according to claim 7, further comprising:

a ring hingedly attached to a clamp, said clamp adapted to allow said clamp to be removably and releasably attached to said flange, said ring adapted to removably receive a finger of a user therethrough.

13. A folding framing square, comprising:

a substantially right triangular shaped framing square having a flange attached substantially perpendicular thereto and forming a substantially "T" shaped section therewith;

a second framing square hingedly attached to a clamp, said clamp adapted to allow said clamp to be removably and releasably attached to said flange.

14. The folding framing square according to claim 13, wherein:

said second framing square has a substantially right-angle trapezium shape.

15. The folding framing square according to claim 13, wherein:

said second framing square has a substantially right-triangular shape.

16. The folding framing square according to claim 13, further comprising:

a ring attached to said second framing square, said ring adapted to removably receive a finger of a user therethrough.

17. The folding framing square according to claim 13, further comprising:

a ring hingedly attached to said second framing square, said ring adapted to removably receive a finger of a user therethrough.

18. The folding framing square according to claim 13, further comprising:

a ring hingedly attached to said clamp, said ring adapted to removably receive a finger of a user therethrough.

19. A folding framing square, comprising:

a substantially right triangular shaped framing square having a flange attached substantially perpendicular thereto and forming a substantially "T" shaped section therewith;

a second framing square hingedly attached to said flange of said substantially right triangular shaped framing square.

20. The folding framing square according to claim 19, wherein:

said second framing square has a substantially right-angle trapezium shape.

21. The folding framing square according to claim 19, wherein:

said second framing square has a substantially right triangular shape.

22. The folding framing square according to claim 19, further comprising:

a ring hingedly attached to said flange of said substantially right triangular shaped framing square.

23. The folding framing square according to claim 22, wherein said ring hingedly attached to said flange opposes said second framing square.

* * * * *